US005345728A

United States Patent [19]

Sugda

[11] Patent Number: 5,345,728

[45] **Date of Patent: *Sep. 13, 1994**

[54] SEWER CHIMNEY COUPLING

[76] Inventor: Peter J. Sugda, 68 Sanrico Dr., Manchester, Conn. 06040-4439

[ * ] Notice: The portion of the term of this patent subsequent to Mar. 15, 2011, has been disclaimed.

[21] Appl. No.: 62,580

[22] Filed: May 17, 1993

Related U.S. Application Data

[60] Continuation-in-part of Ser. No. 22,715, Jan. 11, 1993, Pat. No. 5,293,719, which is a division of Ser. No. 789,922, Nov. 12, 1991, Pat. No. 5,189,861.

[51] Int. Cl.[5] ..... E02D 29/14

[52] U.S. Cl. ..... 52/21; 52/220.8; 52/741.4; 52/745.03

[58] Field of Search ..... 52/220.8, 20, 19, 21, 52/741.1, 741.4, 745.02, 745.03, 745.09, 747; 264/31, 32, 34, 35

[56] References Cited

U.S. PATENT DOCUMENTS

| | | | |
|---|---|---|---|
| 1,712,510 | 5/1929 | Monie | 52/20 |
| 2,728,126 | 12/1955 | Whitlock | 52/220.8 X |
| 3,745,738 | 7/1973 | Singer | 52/741 |
| 4,127,990 | 12/1978 | Morrow | 52/20 X |
| 4,243,068 | 1/1981 | Sugda et al. | 137/363 |
| 4,313,286 | 2/1982 | Harbeke | 52/220.8 |
| 4,472,911 | 9/1984 | Jooris et al. | 52/20 |
| 4,669,759 | 6/1987 | Harbeke | 52/220.8 X |

FOREIGN PATENT DOCUMENTS

| | | | |
|---|---|---|---|
| 0145914 | 6/1985 | European Pat. Off. | 52/220.8 |
| 101935 | 6/1983 | Japan | 52/20 |
| 24728 | 2/1986 | Japan | 52/20 |

*Primary Examiner*—Carl D. Friedman
*Assistant Examiner*—Lan C. Mai
*Attorney, Agent, or Firm*—Blodgett & Blodgett

[57] ABSTRACT

A sewer chimney for connecting a surface branch sewer pipe to a deeply buried main sewer pipe having a fixture with an upwardly facing opening. The chimney is constructed of a plurality of precast concrete elements including a supporting base adjacent the main sewer pipe, one or more transitional sections on the supporting base and a cap block which rests on the upper most transitional section. An elongated vertical pipe extends from the fixture of the main sewer pipe to the cap block. Seals are provided between each of the concrete precast sections and seals are provided between the elongated vertical pipe and components of the construction.

19 Claims, 22 Drawing Sheets

Fig.1
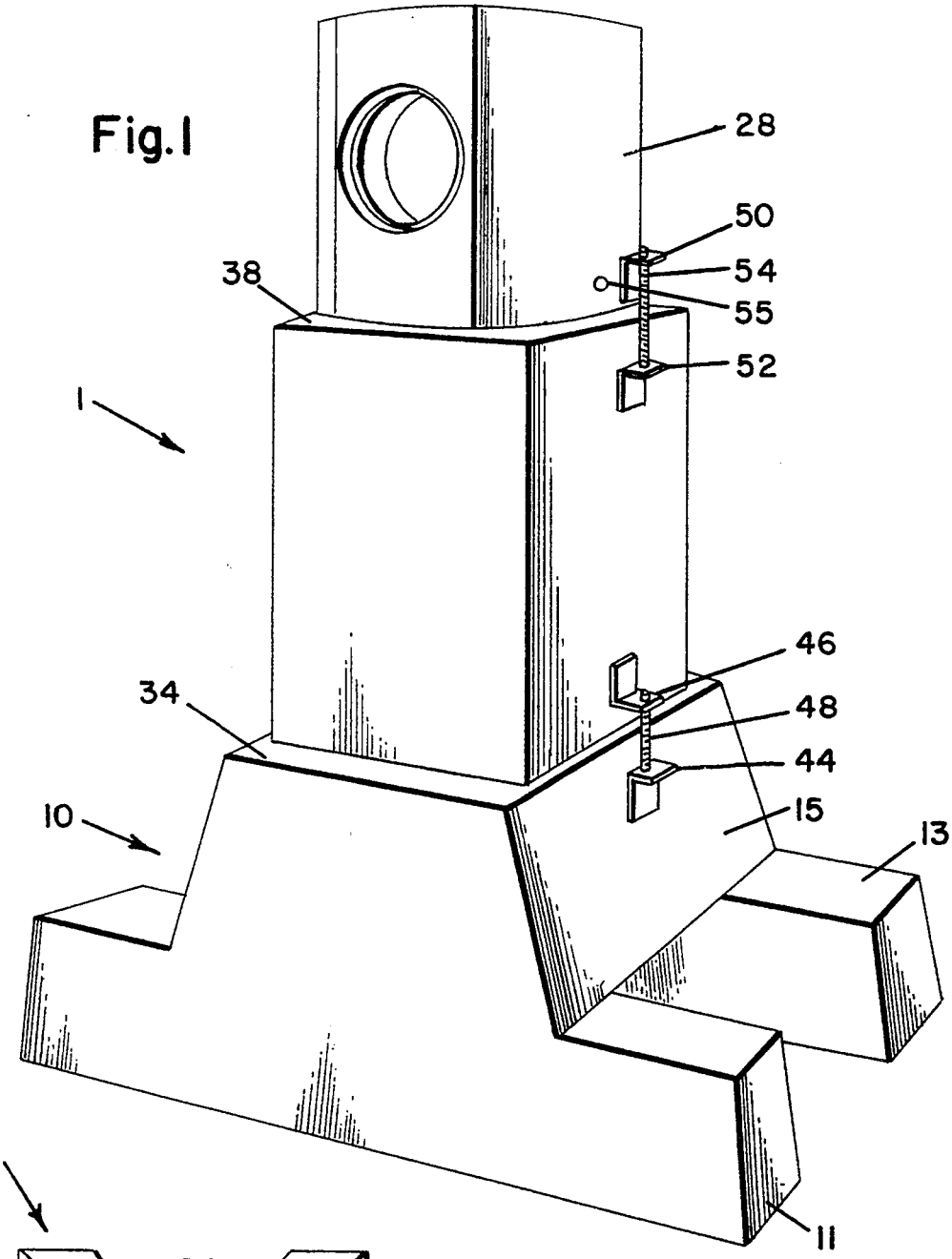
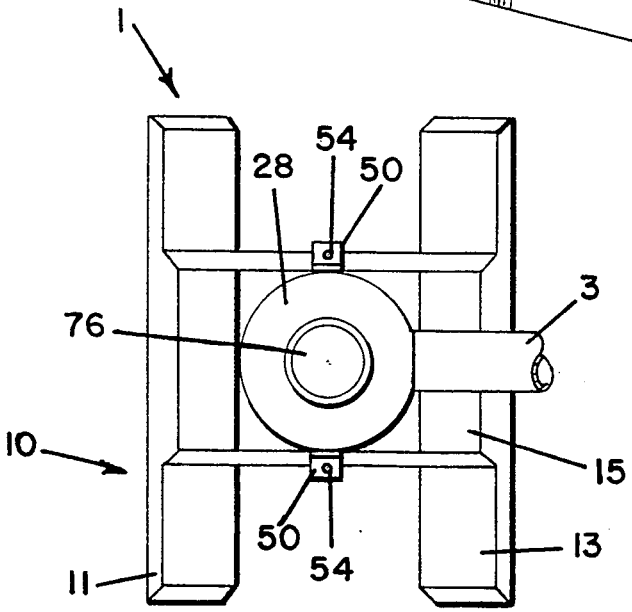
Fig.2

72
74
76
58
56
28
30
32
62
66
64
70
68
3
32
78
80
60
82

72
76
58
74
56
28
30
32
66
62
64
70
86
88
84
32
80
78
60
82

SEWER CHIMNEY COUPLING

This is a continuation-in-part of co-pending application Ser. No. 08/022,715 filed on 11 Jan. 1993, now U.S. Pat. No. 5,293,719 which is a divisional application of application Ser. No. 07/78,922 filed Nov. 12, 1991, now U.S. Pat. No. 5,189,861.

BACKGROUND OF THE INVENTION

The present invention relates to the installation of sewer systems and the like. The invention is particularly directed to a sewer system structure known as a "sewer chimney" which joins a lower sewer main line to an upper sewer branch line. A sewer chimney is usually constructed as an appurtenance to a deep sewer to allow the branch line (building connections or lateral branch lines) to be installed at a shallower depth. These chimneys vary in height and in pipe size, but are typically used for a residence or small commercial building.

Concrete chimneys are typically built by pouring a concrete mix into a form on the job site. This technique produces defective sewer chimney structures as a result of incomplete drying, cracking and overload conditions on the mainline sewer unfavorable weather conditions; many of the problems which are associated with pouring concrete into a form can be avoided by prefabricating the sewer chimneys before they reach the construction site. The prefabricated sewer chimney includes several parts which are assembled at the construction site.

A common problem with such prefabricated concrete sewer chimneys is that parts may not seal properly due to voids in concrete or may vary in the sealing surface being irregular so as to prevent proper construction of the chimney. If the parts do not fit together perfectly, it is difficult or impossible to maintain water-tight seals between the parts.

In the prefab sewer chimney systems which are in current use, a short pipe or nipple extends upwardly from the main line fixture to a fixture in the bridge portion of the supporting base. There is a seal between the main line fixture and the bottom of the nipple, and a seal between the upper portion of the nipple and the bridge portion of the base. The seal in the bridge portion is a gasket which surrounds the upper end of the nipple and which permits relative movement between the nipple and the supporting base while maintaining a water-tight seal between the bridge portion of the base and the nipple. This is an important feature for ease of installation and for allowing for settling of the chimney structure after installation. The cap block at the top of the sewer structure has a built-in T-fixture. The T-fixture and the cap block includes a vertical bore which is vertically aligned with the nipple and the horizontal bore for receiving a service pipe. A captured seal unit is provided between each concrete structure of the chimney so that the system is water-tight from the "T " in the cap block to the main line fixture.

There are two problems which are associated with the nipple which extends from the main line fixture. If the nipple is too long relative to the seal in the bridge portion of the supporting base, there is always a standing volume of sewerage above the seal. Also, if the nipple is cut too long, the top of the nipple may impinge upon the riser section just above the bridge portion of the base, thereby putting pressure on the main line "T" or even structural failure of the mainline tee. This results in a leak at some point in the structure. Even if the riser does not impinge upon the riser section just above the bridge portion during installation of the chimney unit, subsequent settling of the chimney unit may cause the nipple to impinge upon the riser which is located just above the bridge portion creating problems as previously mentioned. If the nipple is too short, the nipple may not extend above the seal in the bridge portion which results in a leak.

There are many other factors which contribute to the failure of present day prefabricated sewer chimneys to maintain a water-tight seal. Although the prefabricated sewer chimneys include seals between each precast concrete section, the seals are often broken or damaged through carelessness of the workers during assembly, failure due to workers using the wrong size seal, or by the units being struck by boulders during the backfilling operation. Damage to these seals can also occur if the sewer chimney is struck by equipment during the installation of service laterals to the building which is being serviced. The placing of too much backfill on one side of the unit causes uneven stresses in the sewer chimney which can also result in damage to the seals. In many cases, the damage to the seals occurs during subsequent service work long after the initial installation of the unit.

Another problem which is associated with existing sewer chimney systems concerns the need to accommodate different types of service pipes. The service pipe specifications vary considerably from one locale to another and for each type of service installation. For example, two commonly used service pipes differ in wall thickness and in outside diameter so that a different block "T" must be used for each type of service pipe used. These and other difficulties experienced with the prior art devices have been obviated in novel manner by the present invention.

It is, therefore, a principal object of the invention to provide a precast sewer chimney which is substantially more resistant to loss of water-tight integrity than existing sewer chimney structures.

Another object of this invention is the provision of a precast sewer chimney which has the ability to accept service pipes of different diameters.

A further object of the present invention is the provision of a precast sewer chimney which can be effectively tested for water-tight integrity in or out of the unit during and immediately after installation of the structure.

It is another object of the present invention to provide a precast sewer chimney which can be effectively tested for water-tight integrity wherein if a leak does occur, it will be pinpointed for repair of the seal at that point.

A still further object of the invention is a provision of a precast sewer chimney structure which can be tested and put into immediate use during construction of the structure thereby eliminating by-pass pumping.

It is a further object of the invention to provide a precast sewer chimney structure which has inner and outer sealing systems thereby greatly increasing the chances that the sewer chimney will maintain its water-tight integrity.

It is a further object of the invention to provide a precast sewer chimney structure which allows for settling of the chimney structure without losing its sealing effectiveness.

It is a further object of the invention to provide a method of installing a precast sewer chimney structure which can be installed easily, quickly and safely.

A further object of the invention is to provide a precast sewer chimney which includes piping within a modular concrete structure, the piping forming a connection between a main sewer line and a surface branch sewer line and being axially and vertically movable relative to the concrete structure to allow for settling of the concrete structure without putting any weight or pressure on the main line pipe.

It is a still further object of the invention to provide a method of installing a precast sewer chimney structure which insures water-tight integrity of the structure.

With these and other objects in view, as will be apparent to those skilled in the art, the invention resides in the combination of parts set forth in the specification and covered by the claims appended hereto.

SUMMARY OF THE INVENTION

The invention consists of a sewer chimney for connecting a surface branch sewer pipe to a deeply buried main sewer pipe having a fixture with an upwardly facing opening. The sewer chimney is made up of a plurality of precast sections including a supporting base, one or more transitional sections which rest on the base and a cap block which rests on the uppermost transitional section. Each section has a vertical bore which is vertically aligned with the upwardly facing opening of the main sewer pipe fixture. The cap block, in addition, has a horizontal bore for receiving a branch sewer pipe. An elongated pipe extends from the main sewer pipe fixture through the vertical bores in each of the sections of the sewer chimney and into the cap block. A water-tight seal is located at each end of the elongated pipe and a seal is located between each precast element of the bridge and its adjacent precast element. The invention also includes a short adapter pipe in the horizontal bore of the cap block and means for retaining the adapter pipe within the horizontal bore, and means to provide a seal between the branch sewer pipe and the cap block. The invention further includes the utilization of one, or more than one, elongated pipe between the main sewer pipe fixture and the cap block and a coupling or bell section for joining the adjacent ends of the pipes which maintain a water-tight seal between the adjacent ends of the pipes. This coupling or bell section acts as a guide to center the pipe within the precast sections thereby making the connecting and alignment of adjacent pipes much easier. The components of the sewer chimney are assembled in a specific manner.

BRIEF DESCRIPTION OF THE DRAWINGS

The characterization of the invention, however, may best be understood by reference to one of its structural forms, as illustrated by the accompanying drawings in which:

FIG. 1 is a perspective view of a sewer chimney embodying the principles of the present invention, FIG. 2 is a top plan view of the sewer chimney.

DETAILED DESCRIPTION OF THE INVENTION

Figure 3:
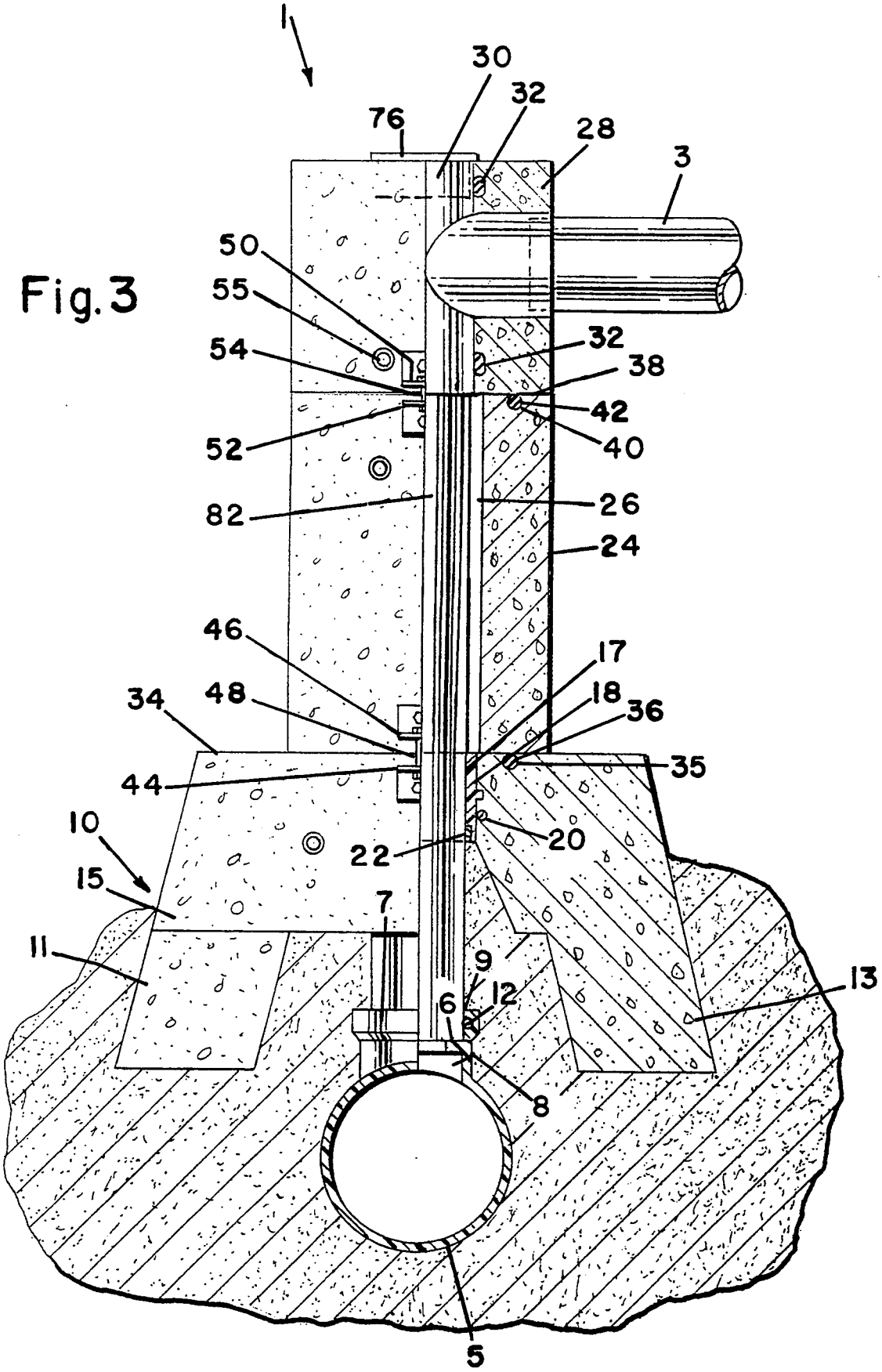
FIG. 3 is a front elevational view of the sewer chimney with portions in cross section.

Referring first to FIGS. 1-3, there is shown a sewer chimney which embodies the principles of the present invention for connecting a shallow branch sewer pipe 3 to a deeply buried main sewer pipe 5. The deeply buried main sewer pipe 5 has a fixture 7 with a vertical bore 8 which opens into an upwardly facing opening 9. The bore 8 has a gasket 12 which is adjacent the opening 9. An annular inwardly extending ridge 6 is located at the lower end of the bore 8 which functions as a stop for a pipe which is inserted into the bore and forms part of the sewer chimney.

The sewer chimney of the present invention is generally indicated by the reference numeral 1 and comprises several precast concrete sections including a supporting base which is generally indicated by the reference numeral 10, a transitional section 24 which is supported on the base 10 and a cap block 28 which is supported on the transitional section 24. The supporting base 10 comprises a first leg portion 11, a second leg portion 13 and a bridge portion 15 which connects the two leg portions 1 i and 13. The leg portions 11 and 13 are located on opposite sides of the fixture 7 and the bridge portion 15 extends above the fixture 7. The bridge portion 15 has a central tube 18 which has a vertical bore 17. The base portions 11 and 13 and the bridge portion 15 are cast as an integral unit, but may be formed as separate units which are connected together. The tube 18 is preferably made of a thermoplastic material which is incorporated into the supporting base 10 when the base is cast and is thereby a permanent part of the base. An outer gasket 20 is embedded in the bridge portion of the base between the tube 18 and the bridge 15. An inner gasket 22 is located in the bore 17 of the tube 18.

The transitional section 24 has a central vertical bore 26 which is vertically aligned with the vertical bore 17. The cap block 28 contains a "T" 30 which is preferably made of thermoplastic material, which is incorporated into the cap block when the cap block is cast. A pair of gaskets 32 are embedded in the concrete portion of the cap block between the cap block and the thermoplastic "T" 30.

The bridge portion 15 has a top surface 34 which has a circular groove 35 which contains an "O" ring 36. The transitional section 24 has a top surface 38 which has a circular groove 40 which contains an "O" ring 42. The "O" rings 36 and 42 extend above their respective grooves so that when the transitional section 24 is placed on the surface 34, the "O" ring 36 forms a seal between the transitional section 24 and the bridge portion 15. When the cap block 28 is placed on the surface 38, the "O" ring 42 forms a seal between the transitional section 24 and the cap block 28. The front and rear face surfaces of each precast concrete section are each provided with brackets to enable the sections to be tied together by bolts. The supporting base 10 has a bracket 44 which is near the upper surface 34 and which is connected to a bracket 46 at the lower end of the transitional section 24 by a bolt 48. The lower end of the cap block 28 has a bracket 50. The upper end of the transitional section 26 has a bracket 52 which is connected to the bracket 50 by a bolt 54.

Each bracket is mounted to its corresponding concrete section by a bolt which is threaded into a threaded plastic tubular insert, not shown, which is embedded into the concrete. The cap block 28 has three threaded inserts on each side of the block. This enables the cap block to assume three different angular positions relative to the transitional section 24.

Each precast concrete section is provided with lift holes 55 which are adapted to receive pins that can be engaged by hooks which form part of mechanical equipment for lowering the section into position.

Figure 5:
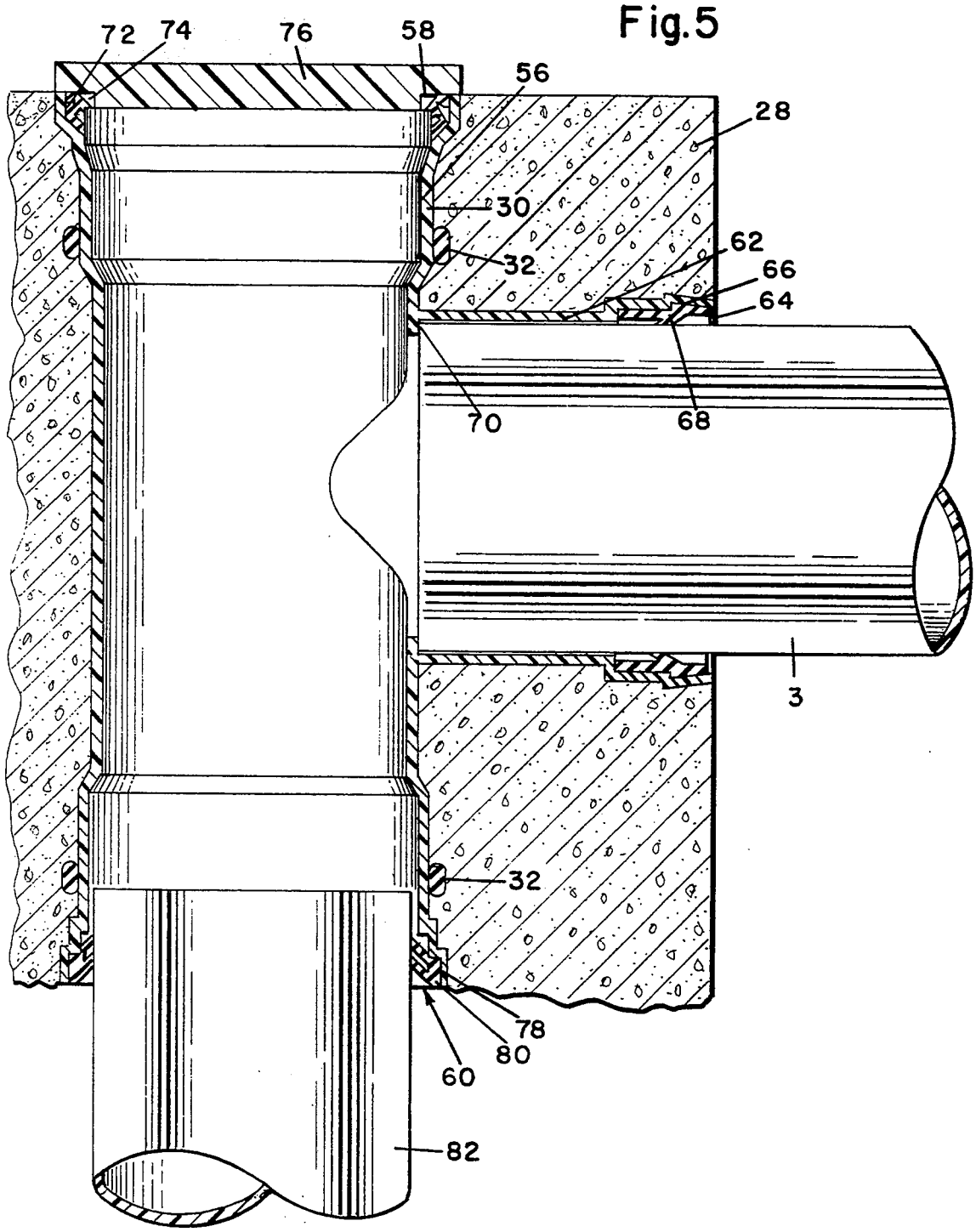
FIG. 5 is a vertical cross-sectional view of the cap block portion of the sewer chimney for holding a heavy walled branch sewer pipe which has a relatively large outside diameter.

Referring particularly to FIG. 5, the "T" 30 has a vertical bore 56 which is vertically aligned with the vertical bores 26 and 17 of the transitional section 24 and the bridge portion 15, respectively. The "T" 30 has a horizontal bore 62 which extends laterally from the bore 56 to an outer opening 64. The bore 62 has an annular groove 66 which is adjacent the outer opening 64 and which contains a gasket 68. The vertical bore 56 has a top opening 58 and a bottom opening 60. The bore 56 has an annular groove 72 adjacent the upper opening 58 and an annular groove 78 adjacent the bottom opening 60. A gasket 74 is located in the annular groove 72 and a gasket 80 is located in the annular groove 78. The top opening 58 is closed by a cap 76 which engages the gasket 74 to form a water-tight seal at the upper end of the sewer chimney.

If the bracket 50 is mounted to the middle insert, the horizontal bore 62 extends at a right angle to the main sewer line 5. The other two inserts enable the cap block to be positioned on the transitional section 24 a predetermined number of degrees on either side of a line which is normal to the longitudinal axis of the main sewer line 5. This feature provides versatility of direction to the sewer chimney when connecting the sewer chimney to a branch sewer pipe.

Referring particularly to FIGS. 3 and 5, an elongated pipe 82 extends from the fixture 7 of the main sewer line through the vertical bores 17 and 26 and into the vertical bore 56 to a point below the horizontal bore 62. The gasket 12 provides a static seal between the bore 8 and the elongated pipe 82. The gasket 80 provides a slidable static and dynamic seal between the pipe 82 and the vertical bore 56. This allows for relative movement between the elongated pipe 82 and the cap block 28. This relative movement is likely to occur during settling of the sewer chimney structure after installation. This relative movement also insures that stresses do not develop in the structure between the sewer chimney structure and the main sewer line while sealing integrity is maintained between the elongated pipe 82 and the cap block 28. The length of the elongated pipe 82 varies in accordance to the height of the intermediate or transitional section 24. The seals between the concrete sections of the chimney and the seals which are associated with the elongated pipe 82 provide a double seal condition so as to prevent any possible infiltration or exfiltration of liquids. An annular ridge 70 is located between the vertical bore 56 and the horizontal bore 62. The ridge 70 functions as a stop to prevent the branch sewer pipe 3 from entering the vertical bore 56.

Figure 6:
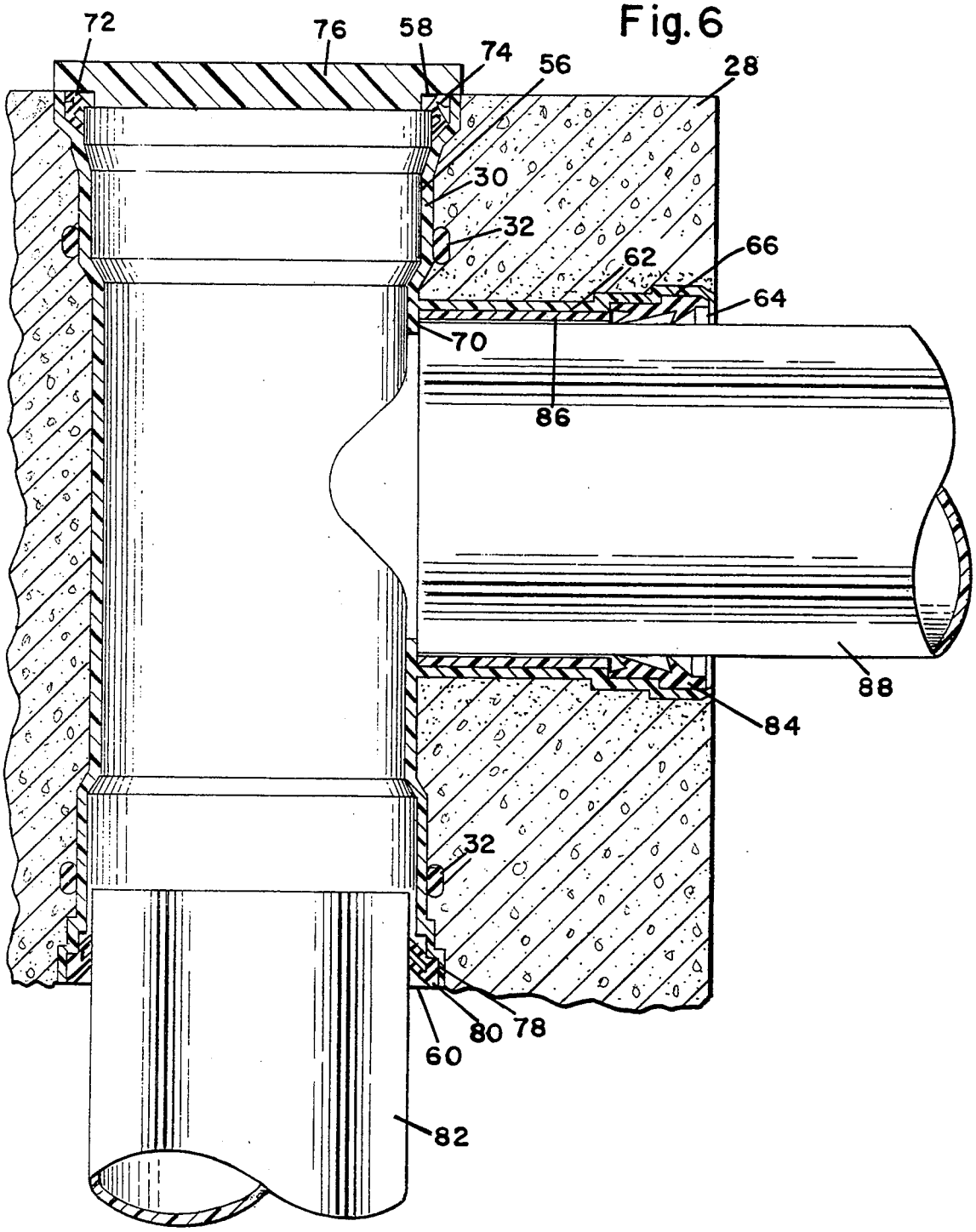
FIG. 6 is a view similar to FIG. 5 showing an adapter for enabling the cap block to hold a relatively small outside diameter branch sewer pipe.

Referring particularly to FIGS. 5 and 6, the service pipe 3 is a relatively large outside diameter pipe which fits comfortably within the horizontal bore 62 with sufficient clearance to enable the pipe to be inserted relatively easily into the bore. When a relatively small outside diameter service pipe 88 is utilized, a short adapter tube 86 is inserted into the bore 62 prior to the application of a sealing gasket 84 into the annular groove 66 so that the adapter tube 86 is trapped between the ridge 70 and the gasket 84 as shown in FIG. 6. The gasket 84 is relatively larger than the gasket 68 which is utilized with the service pipe 3. The ridge 70 extends inwardly to a sufficient degree so that a continuous function as a stop to prevent the inner end of the service pipe 88 from entering the vertical bore 56. The gasket 84 provides a water-tight seal between the branch sewer pipe 88 and the "T" 30 of the cap block 28.

Figure 4:
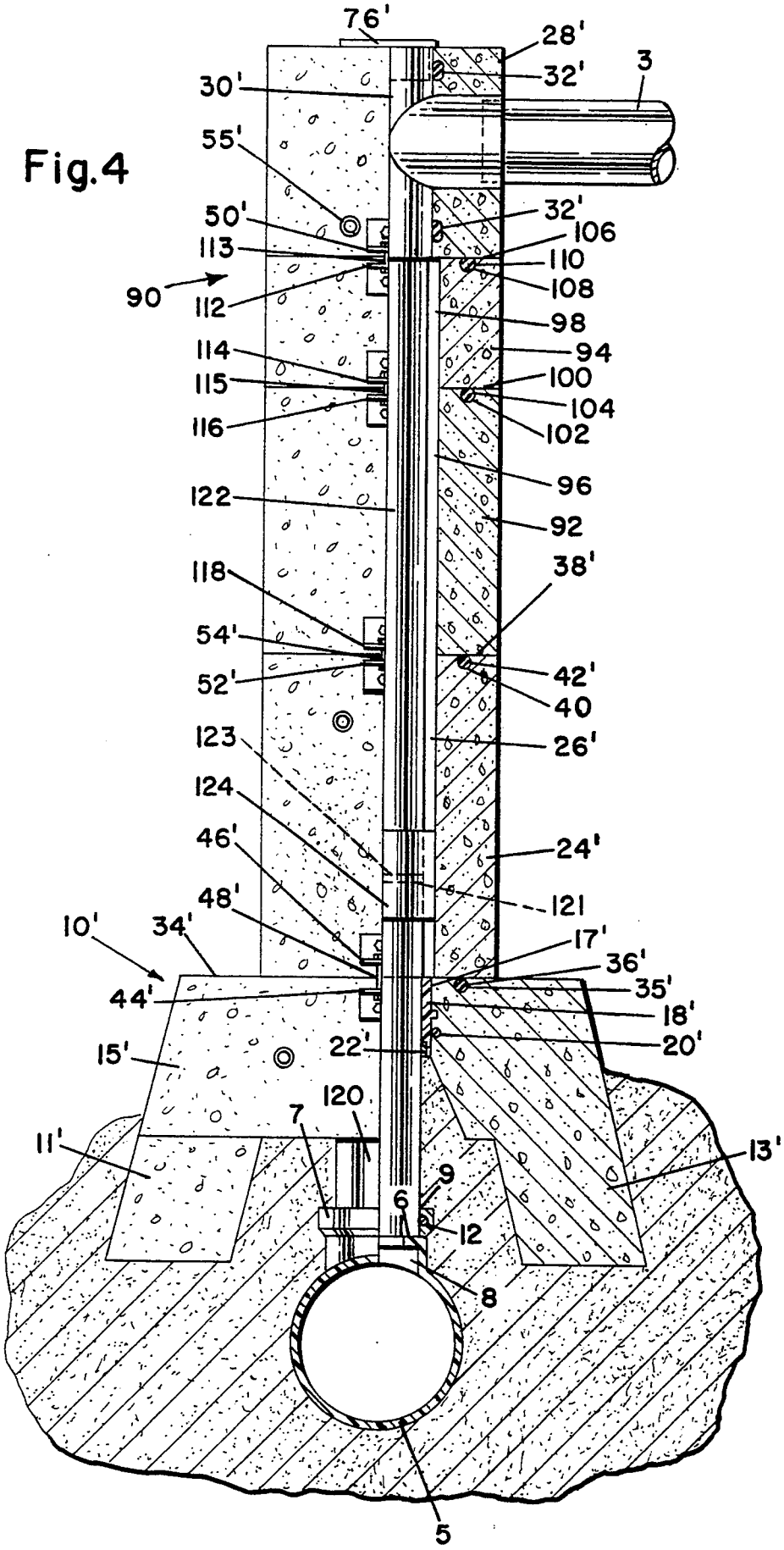
FIG. 4 is a view similar to FIG. 3 showing a modification for relatively tall chimneys.

Referring to FIG. 4, there is shown a modified sewer chimney of the present invention which is generally indicated by the reference numeral 90. The sewer chimney 90 is a relatively tall sewer chimney for connecting the branch sewer pipe 3 to the main sewer pipe 5 wherein the main sewer pipe 5 is located at a considerably greater depth than for the application which is illustrated in FIG. 3. The modified sewer chimney 90 includes a supporting base 10' which is identical to the supporting base 10 and includes first and second leg portions 11' and 13', respectively and a bridge portion 15'. The bridge portion 15'includes a central plastic tube 18' which has a vertical bore 17' The sewer chimney 90 also includes a cap block 28' which is identical to the cap block 28 so that all elements of the cap block 28' have the same reference numeral as the corresponding elements of the cap block 28 with the addition of a prime after each numeral. The cap block 28' is located at a considerably higher distance from its supporting base than the cap block 28 is from its supporting base. Because of this greater vertical distance, several transitional precast concrete sections are utilized. The first transitional section is identified by the reference numeral 24' and is identical to the transitional section 24. All the elements of section 24' are identified by the same reference numeral as for the section 24 with the addition of a prime after each numeral. In the example shown in FIG. 4, two additional transitional sections are utilized, sections 92 and 94. The number and size of the transitional sections which extend between the cap block and the supporting base depends on the distance between these two elements. In the example shown in FIG. 4, the transitional section 92 has an upper surface 100 which has a groove 102 that contains an "O" ring 104 for forming a seal between the sections 92 and 94. The transitional section 94 has an upper surface 106 which has a circular groove 108 which contains an "O" ring 110 for forming a water-tight seal between the section 94 and the cap block 28'. The transitional section 92 has a vertical bore 96 which is vertically aligned with the vertical bore 26' and the vertical bore 17'. The transitional section 94 has a vertical bore 98 which is vertically aligned with the bores 96, 26' and 17'. The lower portion of the section 92 has a bracket 118 which is connected to the bracket 52' of the section 24' by the bolt 54'. The upper end of the section 92 has a bracket 116 which is connected to a bracket 114 of the transitional section 94 by a bolt 114. The upper end of the transitional section 94 has a bracket 112 which is connected to the bracket 50' by a bolt 113. The brackets and connecting bolts for the sections of the sewer chimney are illustrated in FIG. 4 on the front face of the sewer chimney. The rear face of the sewer chimney (not shown) has an identical pattern of brackets and bolts. The embodiment of FIG. 4 includes two vertical connecting pipes, a lower pipe 120 and an upper pipe 122. The lower end of the pipe 120 is located in the fixture 7 of the main sewer pipe. The upper end of the pipe 122 is located in the "T" 30'. The upper end of the pipe 120 is identified by the reference numeral 121 and extends above the surface 34' of the bridge portion 15'. The bottom end of the pipe 122 is identified by the reference numeral 123 and is located just above the upper end 121 of the pipe 120. The upper end 121 of the pipe 120 is connected to the lower end 123 of the pipe 122 by a coupling 124.

Figure 7:
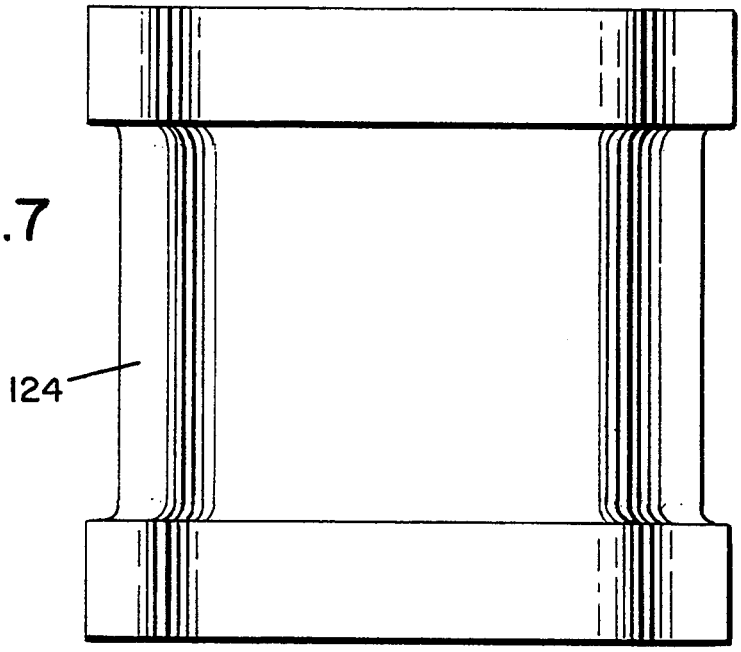
FIG. 7 is an elevational view of a coupling for the embodiment shown in FIG. 4 which is used to join two lengths of pipe within the sewer chimney.
Figure 8:
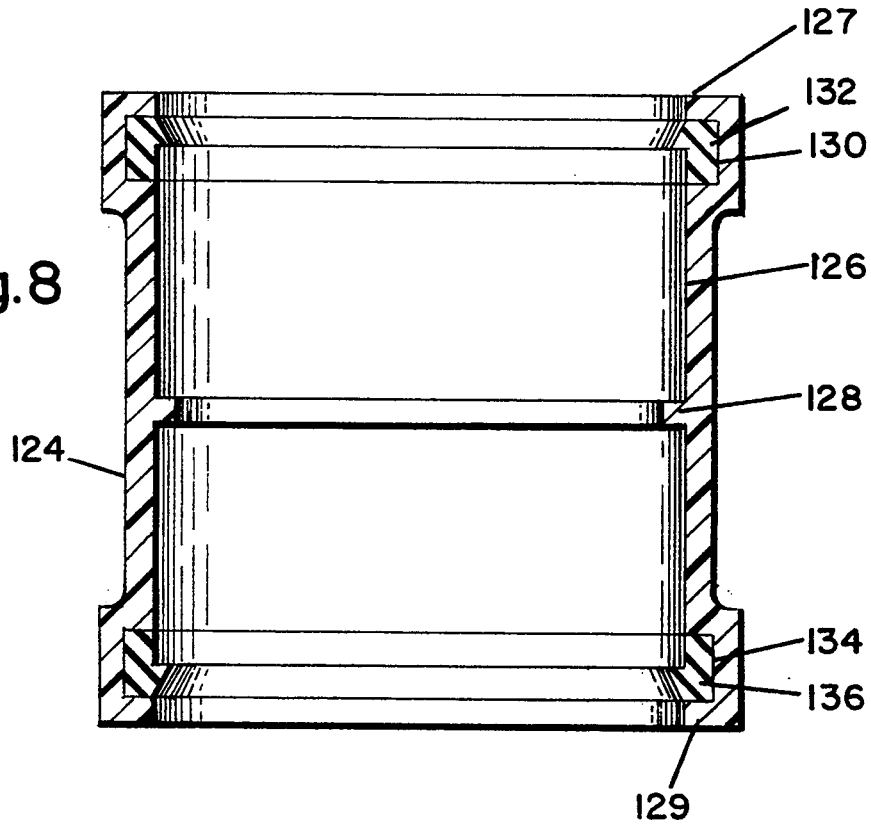
FIG. 8 is a vertical cross-sectional view of the coupling.

Referring to FIGS. 4, 7 and 8, the coupling 124 has a vertical bore 126 which has a top opening 127 and a bottom opening 129. The bore 126 has an upper annular groove 130 which is adjacent the top opening 127 and which contains a gasket 132. The bottom end of the bore 126 has an annular groove 134 which is adjacent the bottom opening 129 and which contains a gasket 136. The bore 126 has a central annular inwardly extending ridge 128 which functions as a stop for the upper end 121 of the pipe 120 and the lower end 123 of the pipe 122. The gaskets 132 and 136 provide a water-tight seal between the pipes 120 and 122 and the coupling 124. If the distance between the main sewer pipe 5 and the branch sewer pipe 3 is greater than that which is shown in FIG. 4, additional transitional sections are utilized as well as additional connecting pipes between the branch sewer pipe and the main sewer pipe. Each additional connecting pipe is connected to an adjacent pipe by a coupling 124.

Figure 9:
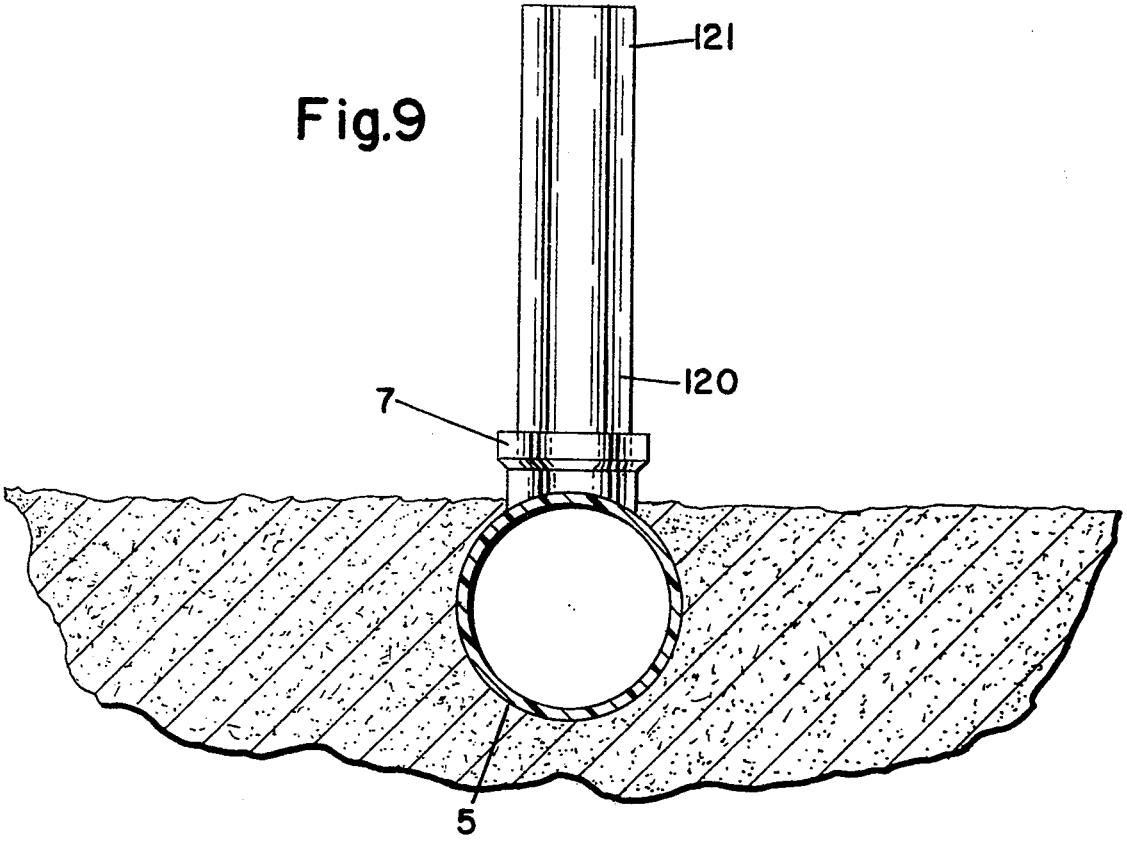
FIGS. 9-15 illustrate steps in the method of constructing the sewer chimney embodiment which is shown in FIG. 4.
Figure 10:
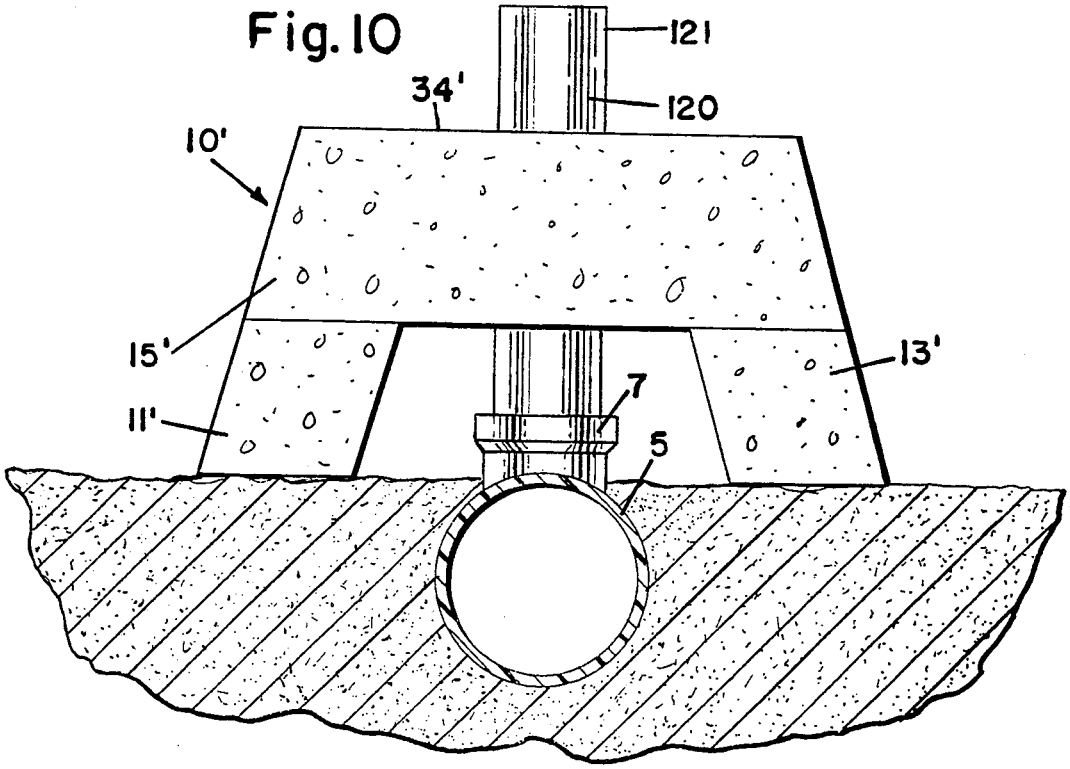
Figure 11:
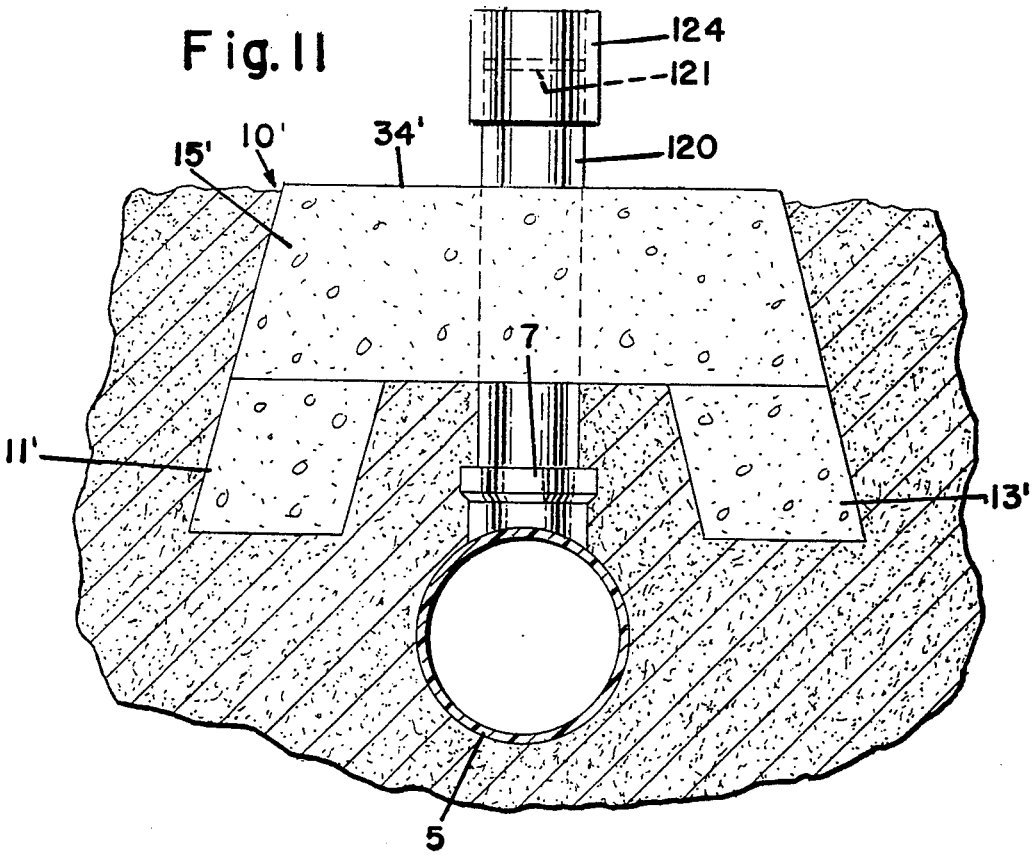
Figure 12:
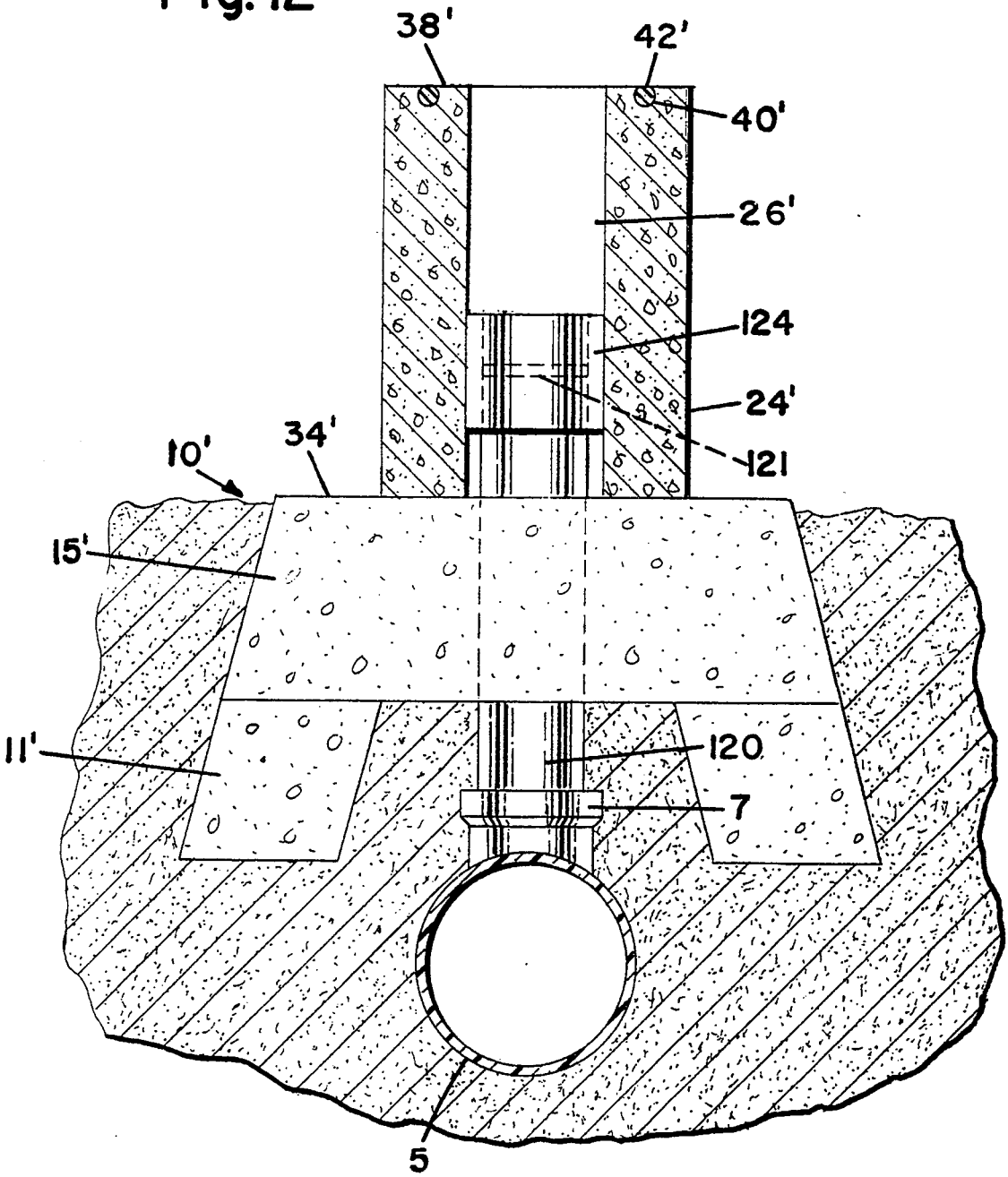

Referring to FIGS. 9-15, the installation and operation of the invention will now be readily understood in view of the above description. FIGS. 9–15 illustrate the construction of the embodiment 90 which is shown in FIG. 4. At the beginning of the construction, the installer inspects all parts of the prefabricated sewer chimney for any shipping damage. The work on the sewer chimney can begin as soon as the excavation has been completed. The trench in which the sewer chimney is being constructed is filled with appropriate backfill material such as sand or screened gravel. The backfill material is level and compacted to a specific height below the top of the fixture 7 as shown in FIG. 9. A temporary cap on the bell 7 is removed and the pipe 120 is inserted into the bell 7 down to the stop 6. The supporting base 10' is then lowered into the trench over the vertical pipe 120 so that the pipe extends upwardly through the bore 17' of the bridge 15' and the base legs 11' and 13' rest on the gravel on opposite sides of the fixture 7 as shown in FIG. 10. The entire area under the bridge 15' is filled with sand and the coupling 124 is then applied to the upper end 121 of the pipe 120 as shown in FIG. 11.

Figure 13:
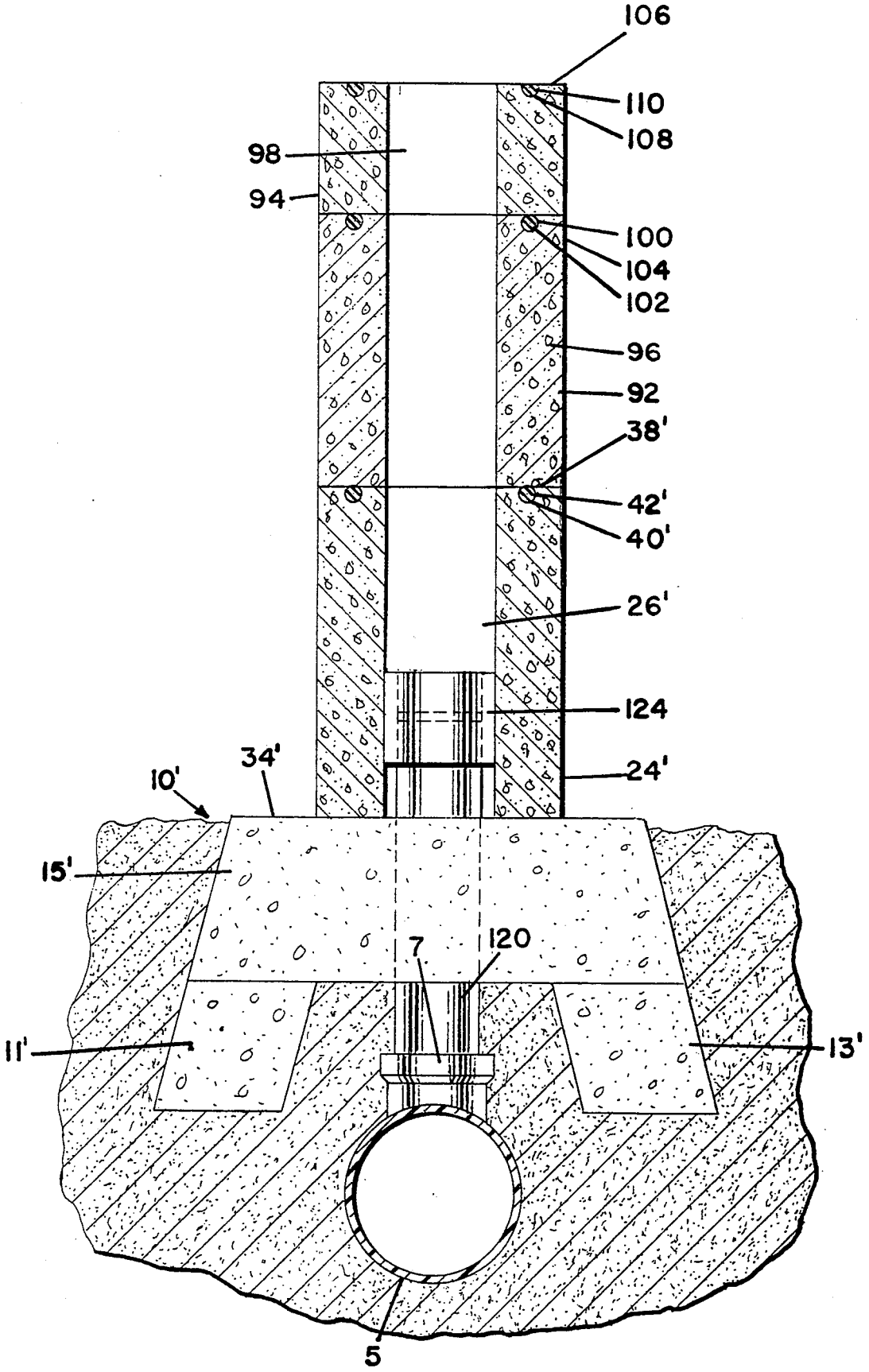

The transitional section 24' is lowered into the trench over the vertical pipe 120 so that the upper end of the pipe and the coupling 124 extend into the bore 26' and so that the transitional section 24' rests on the upper surface 34' of the bridge. The transitional section 24' is then bolted to the bridge portion 15' by means of the brackets 44' and 46'. The additional two transitional sections 92 and 94 are then added to the structure as shown in FIG. 13. Prior to the addition of each transitional section, care is utilized to make sure that the bottom and top surfaces of the sections are clean and free of dirt so that as each "0" ring is inserted into its appropriate circular groove at the top of one section it forms a water-tight seal between that section and the adjacent section above. As each transitional section is added, it is bolted to the previous section by means of the brackets which extend from each section.

Figure 14:
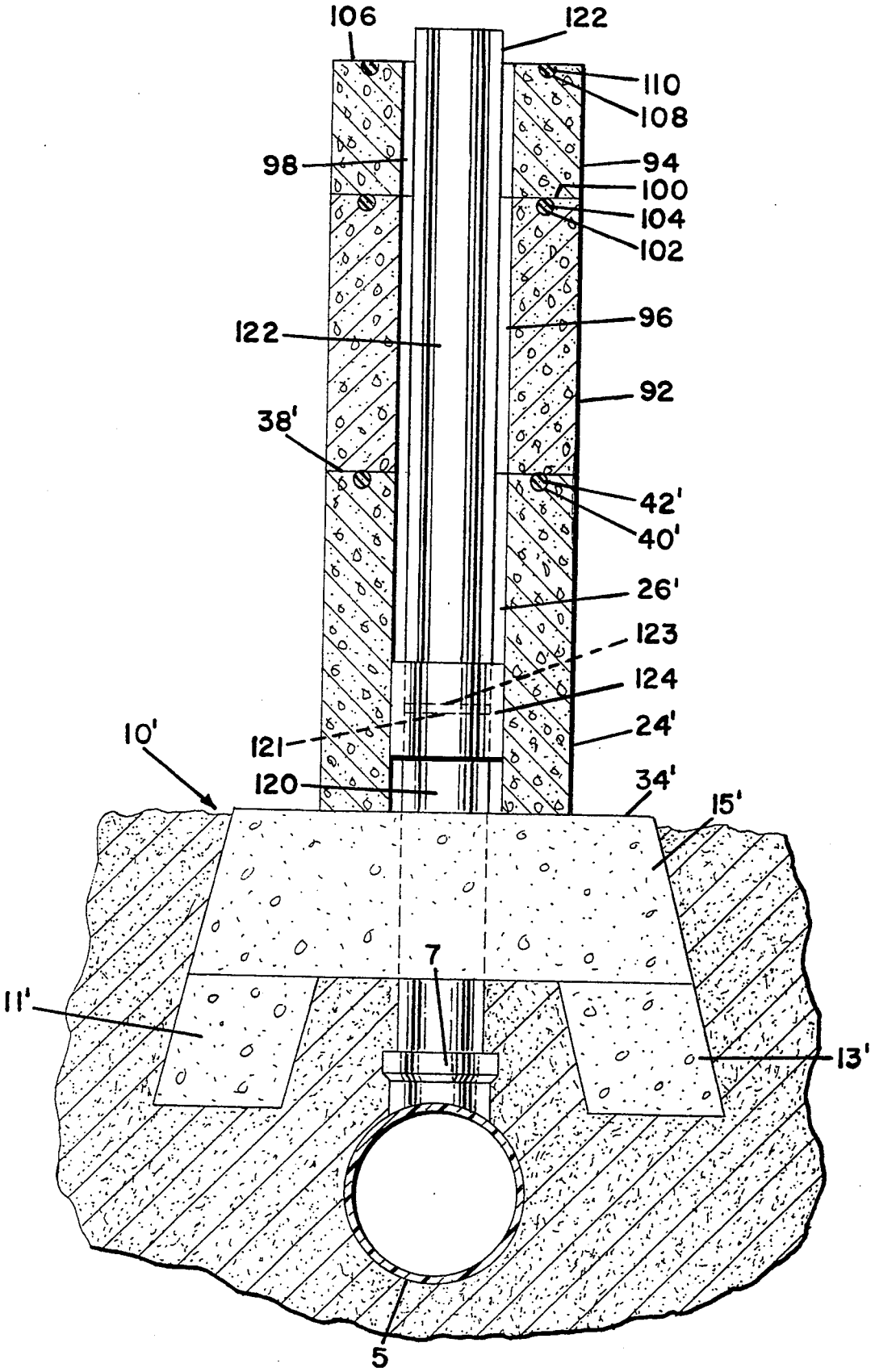
Figure 15:
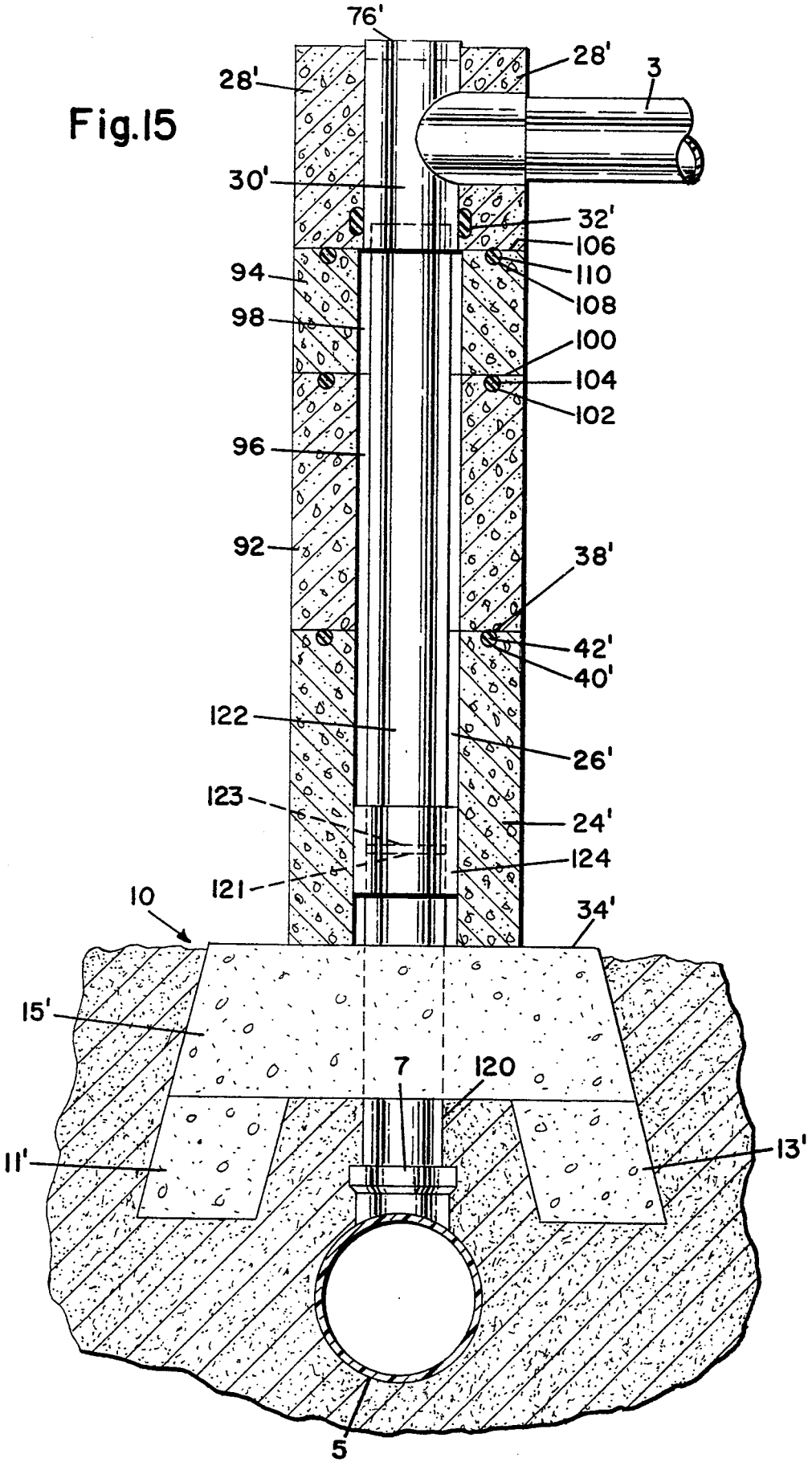

After all of the transitional sections have been added to the structure and tied together, the second pipe 122 is inserted into the coupling 124 so that the bottom end of the pipe extends into the coupling and the top end of the pipe extends to a point above the uppermost transitional section 94 as shown in FIG. 14. Water is placed in the bore spaces 98, 96 and 26. This fills the void between the interior pipe and concrete sections. As soon as this cap block is placed and drawn down, the water within the bore spaces is pressurized and the unit is automatically tested. If the interior pipe seals are defective, the water will shoot inside. If the outer seals are defective, the water will flow to the exterior. If the bottom bridge seal is defective, the water will go down. If there is a major leak, it will be noticeable before placing the cap as the water will drop in elevation immediately, or the installer will not be able to fill the void fast enough to get the water to the top. The cap block 28' is then mounted onto the transitional section 94 so that the top end of the pipe 122 extends into the vertical bore of the "T" 30' at a point below the horizontal bore of the "T" as shown in FIG. 15. The service sewer pipe 3 is then inserted into the horizontal bore of the "T" 30' as shown in FIG. 15. The cap block 28' is bolted to the upper transitional section 94 and the top opening of the horizontal bore of the "T"30' is closed by the cap 76'. For certain installations, the cap block is bolted to the upper transitional section 94 prior to the insertion of the service pipe 3 into the "T" 30.

The short sewer chimney which is shown in FIG. 3 is constructed by first inserting the single elongated pipe 82 into the main sewer line fixture 7 and then adding the supporting base 10, transitional section 24 and cap block 28 in succession so that the pipe 82 extends through the vertical bores 17 and 26 and into the bore 56 of the cap block. The transitional section 24 is bolted to the supporting base 10 and the cap block 28 is bolted to the transitional section 24. The lateral service pipe 3 is inserted into the horizontal bore of the "T" 30. The top opening of the vertical bore 56 is sealed by the cap 76.

For certain installations, the pipe 82 is inserted first into the base 10 and the base and pipe are lowered so that the pipe enters the fixture 7 and the base is positioned at its proper supporting position.

Figure 16:
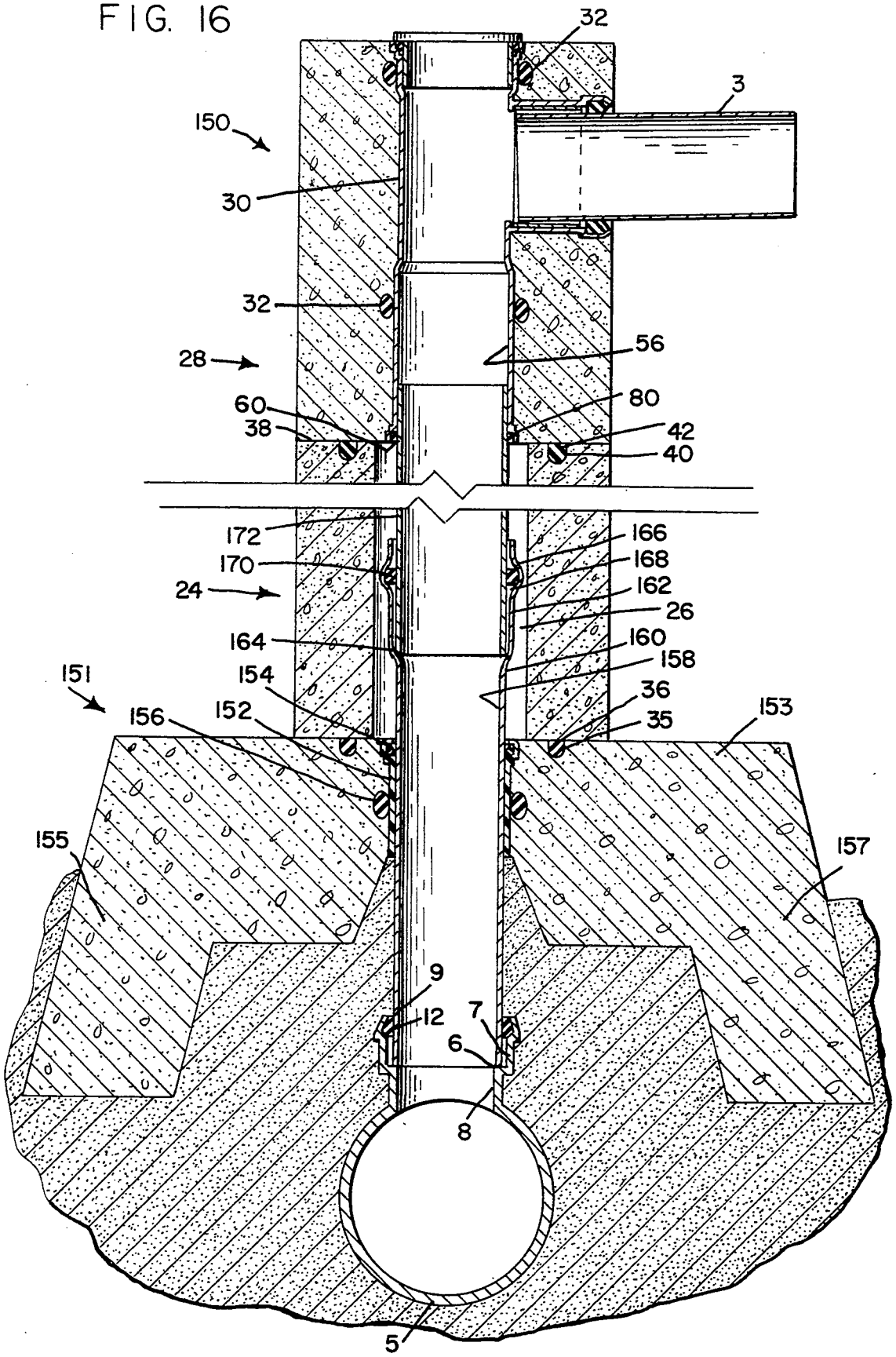
FIG. 16 is a vertical cross-sectional view of a further embodiment of a sewer chimney embodying the principles of the present invention.

Referring to FIG. 16 there is shown a further modified sewer chimney of the present invention which is generally indicated by the reference number 150 and comprises the several precast concrete sections of the embodiment which is shown in FIG. 3. The precast sections include a supporting base which is generally indicated by the reference numeral 15 1. The base 151 is similar to the base 10 in that it comprises a first leg portion 155, a second leg portion 157, and a bridge portion 153 which connects the two leg portions 155 and 157. The other precast portions include the same transitional section 24 and the cap block 28 which form part of the embodiment shown in FIG. 3. The sewer chimney 150 is shown in FIG. 16 positioned above a deeply buried main sewer pipe 5. The cap block 28 is shown connected to the shallow branch sewer pipe 3.

The bridge portion 151 has a sleeve 152 of a thermoplastic material such as polyvinylchloridc which is incorporated into the supporting base when the base is cast and is thereby a permanent part of the base. The sleeve 152 has a vertical bore 158. The upper end of the bore 158 has an inner groove 159 which contains an annular inner gasket 154. An outer gasket 156 is embedded in the bridge portion 153 between the sleeve 156 and the bridge 153. A first pipe 160 is located within the bore 158 of the sleeve 152. The lower end of the pipe 160 rests on the annular ridge 6 of the main sewer pipe 5. The upper end of the pipe 160 extends above the bridge portion 153 into the bore 26 of the transitional section 24. The upper end of the pipe 160 has an enlarged section or bell 162 which has an annular outwardly directed bulge 166 which forms an annular inner groove 168. An annular gasket 170 is located within the groove 168 and forms a seal between the first pipe 160 and a second pipe 172 which fits inside of the bell 162. The bottom of the pipe 172 rests against an internal stop 164 which is formed at the transition point between the main portion of the pipe 160 and the bell section 162. The upper end of the pipe 172 extends into the bore 56 of the cap block 28. The annular gasket 80 forms a seal between the pipe 172 and the "T" 30 of the cap block.

Figure 17:
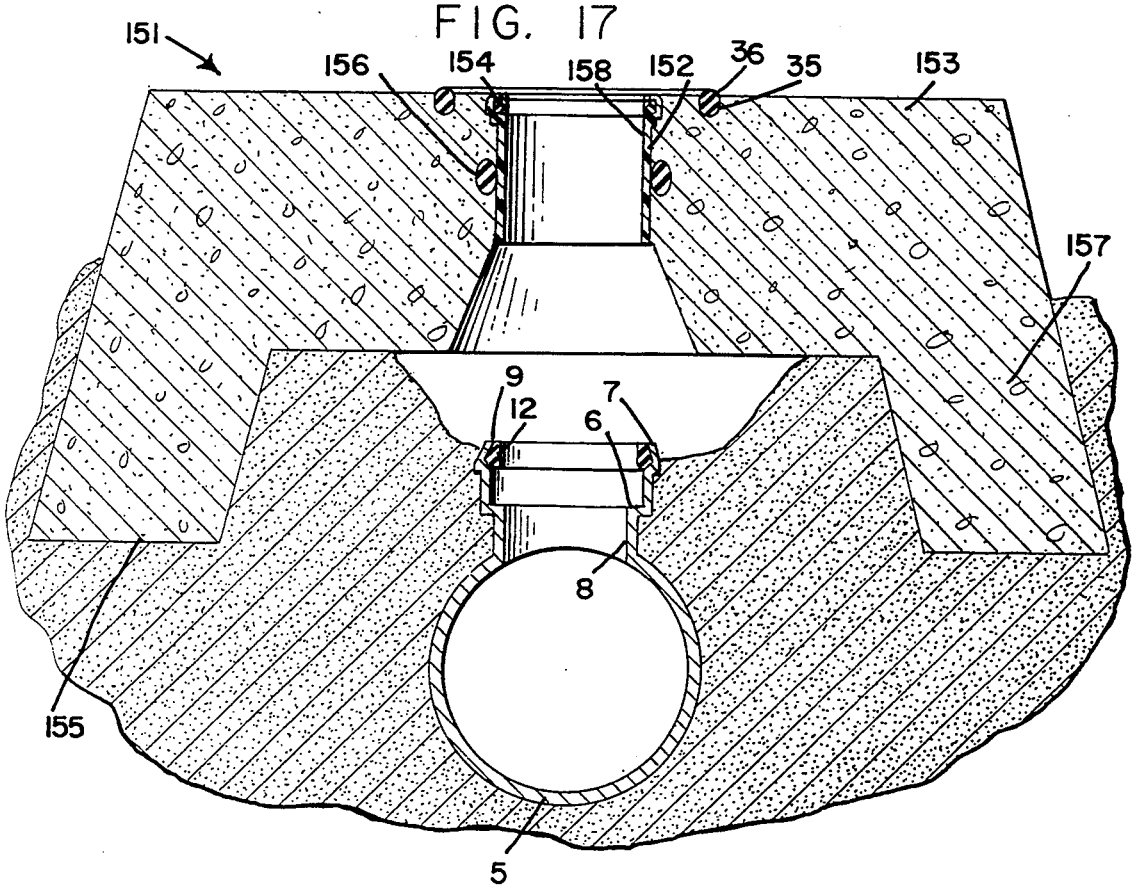
FIGS. 17-20 illustrate the steps in the method of constructing the sewer chimney embodiment which is shown in FIG. 16.
Figure 18:
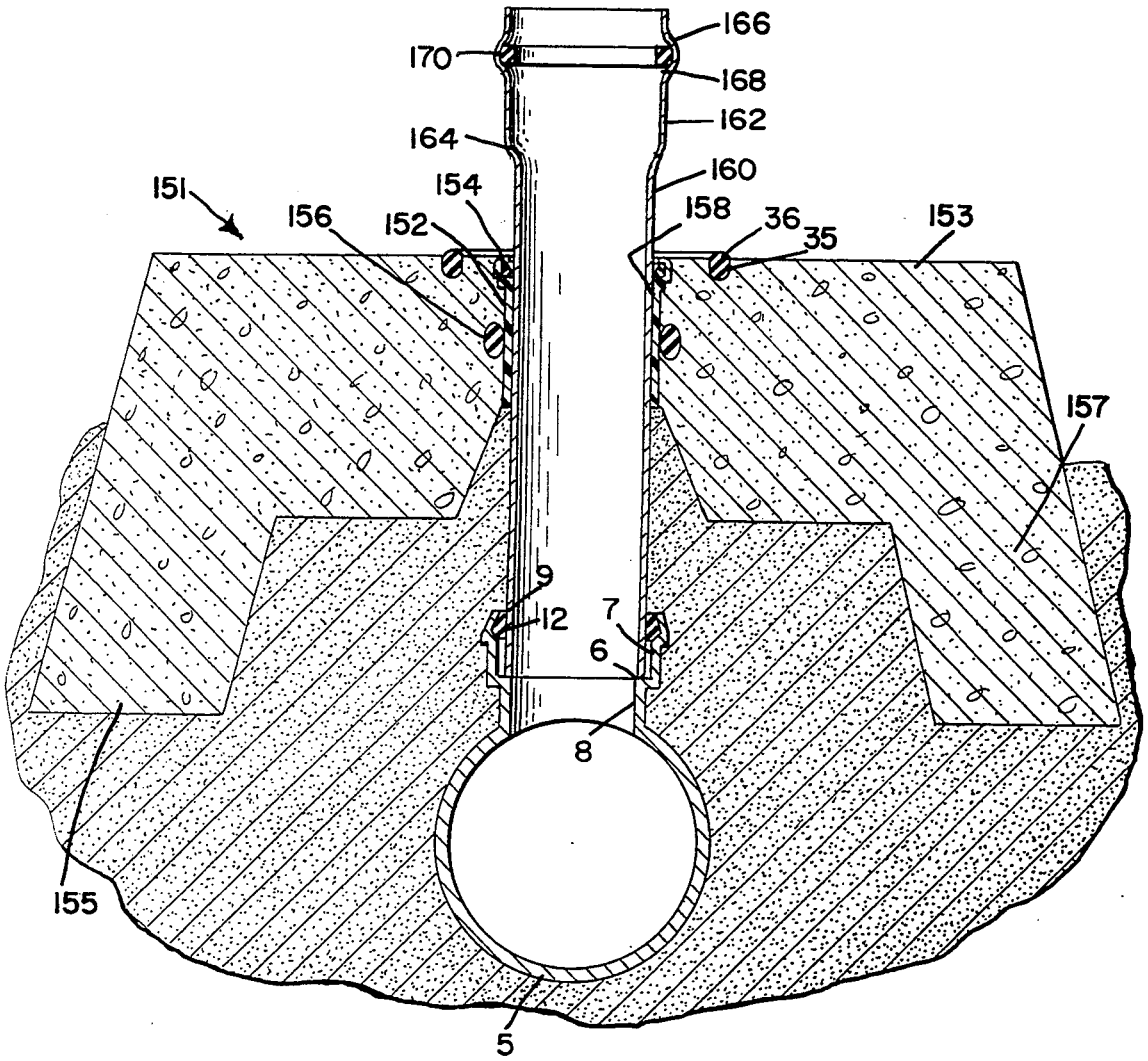
Figure 19:
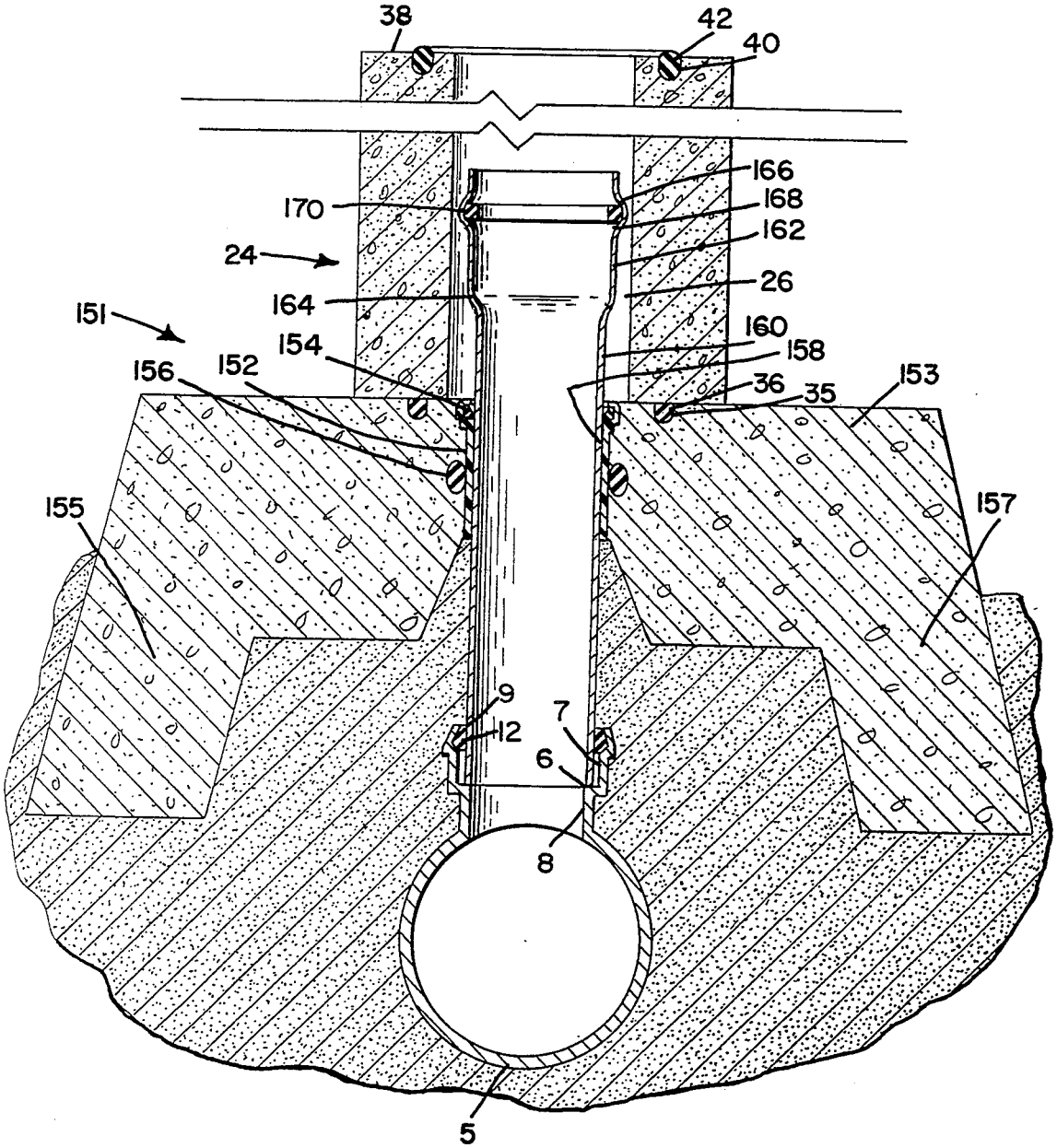
Figure 20:
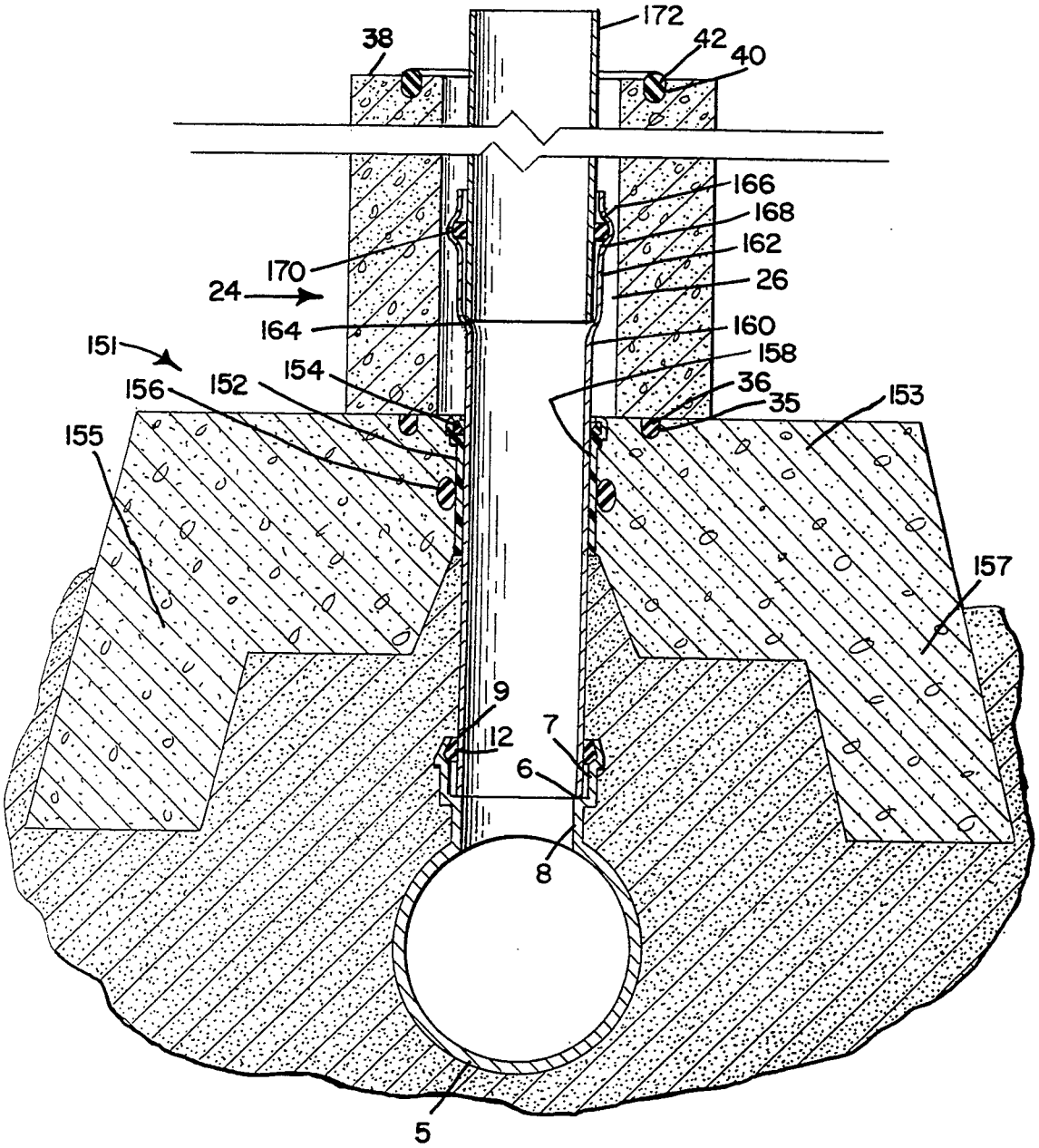

The steps for constructing the sewer chimney 150 are illustrated in FIGS. 17-20 The base 15 1 is first positioned above the main sewer pipe 5 so that the bore 158 of the base is vertically aligned with the top opening 9 of the fixture 7 of the sewer pipe 5 as illustrated in FIG. 17. The first pipe 160 is then inserted through the bore 158 and into the opening 9 so that the bottom of the pipe rests on the interior ridge 6 of the fixture 7 as shown in FIG. 18. The upper bell section 162 extends above the base 151. The gasket 36 is then placed within the annular groove 35 of the base and the transitional section 24 is then positioned on the base as shown in FIG. 19. The second pipe 172 is coupled with the first pipe 160 by inserting the second pipe into the bore 26 and into the upper bell 162 so that the bottom of the second pipe 172 strikes the internal stop 164 and the upper end of the second pipe extends above the transitional section 24 as shown in FIG. 20. For most applications, it is preferred to reverse the last two steps by coupling the first and second pipes 172 and 160, respectively, and then applying the transitional section 24 to the base. Finally, the gasket 42 is placed within the groove 40 and the cap block 28 is applied to the transition section 24 so that the top of the second pipe 172 extends through the bottom opening 60 of the cap block and into the bore 56 as shown in FIG. 16. The transitional section 24 is coupled to the base 15 1 and the cap block 28 by the brackets and bolts which are described in connection with the embodiment shown in FIG. 3. Although the space beneath the bridge 153 can be filled with sand anytime after the insertion of the first pipe 160, this step is preferably accomplished after the sewer chimney has been constructed. Thereafter, the excavation around the sewer chimney is filled with acceptable backfill. When the sewer chimney settles, it will move downwardly relative to the pipes 160 and 172. There is sufficient space within the bore 56 of the cap block 28 to allow the top of the second pipe 172 to move upwardly from the bottom opening 60 as the sewer chimney settles. This prevents the weight of the sewer chimney from impacting on the main line pipe as a result of settling.

Figure 21:
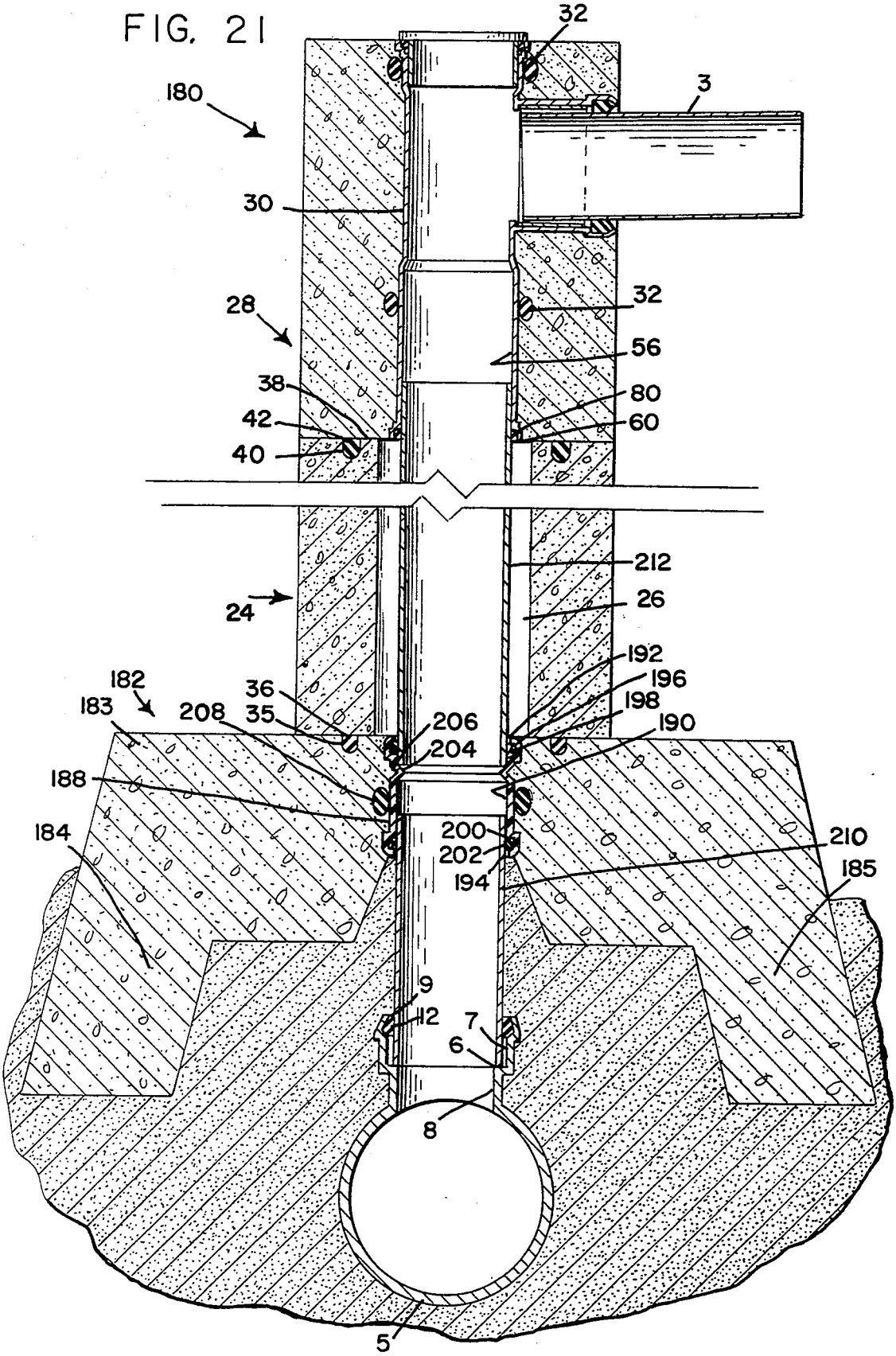
FIG. 21 is a vertical cross-sectional view of a still further embodiment of a sewer chimney embodying the principles of the present invention.

Referring to FIG. 21, there is shown a still further modified sewer chimney which is generally indicated by the reference numeral 180. The sewer chimney 180 comprises several precast concrete sections including a supporting base which is generally indicated by the reference numeral 182, the transitional section 24 which is supported on the base 182 and the cap block 28 which is supported on the transitional section 24. The supporting base 182 is similar to the supporting base 10 and comprises a first leg portion 184, a second leg portion 185 and a bridge portion 183 which extends above the fixture 7 of the main sewer pipe 5. The bridge portion 183 includes a coupling sleeve 188 which has a vertical bore 190. The bore 190 has a top opening 192, a bottom opening 194, an inner annular groove 196 near the top opening 192, and an inner annular groove 200 near the bottom opening 194. An annular gasket 198 is located within the groove 196 and an annular gasket 202 is located within the groove 200. The wall of the coupling sleeve 198 has an inwardly directed jut which defines an inner annular ridge 204 and an outer annular groove 206. The ridge 204 is located below the groove 198 and forms an interior stop. The coupling sleeve 188 is preferably made of a thermoplastic material such as polyvinylchloride which is incorporated into the supporting base 182 when the base is cast and is, thereby, a permanent part of the base. The outer groove 206 helps to lock the coupling sleeve into the concrete portion of the base. A first pipe 210 extends from the ridge 6 of the fixture 7 into the bore 190 to a point which is spaced from and below the ridge or interior stop 204. The gasket 202 forms a seal between the coupling sleeve 188 and the first pipe 210. A second pipe 212 extends from the interior stop 204 upwardly through the bore 26 of the transitional portion 24 and into the bore 56 of the cap block 28. The gasket 80 forms a seal between the cap block 28 and the first pipe 212. The gasket 198 forms a seal between the lower end of the pipe 212 and the coupling sleeve 188. An annular gasket 208 is embedded in the bridge portion 183 of the base between the coupling sleeve 188 and the bridge 183.

Figure 22:
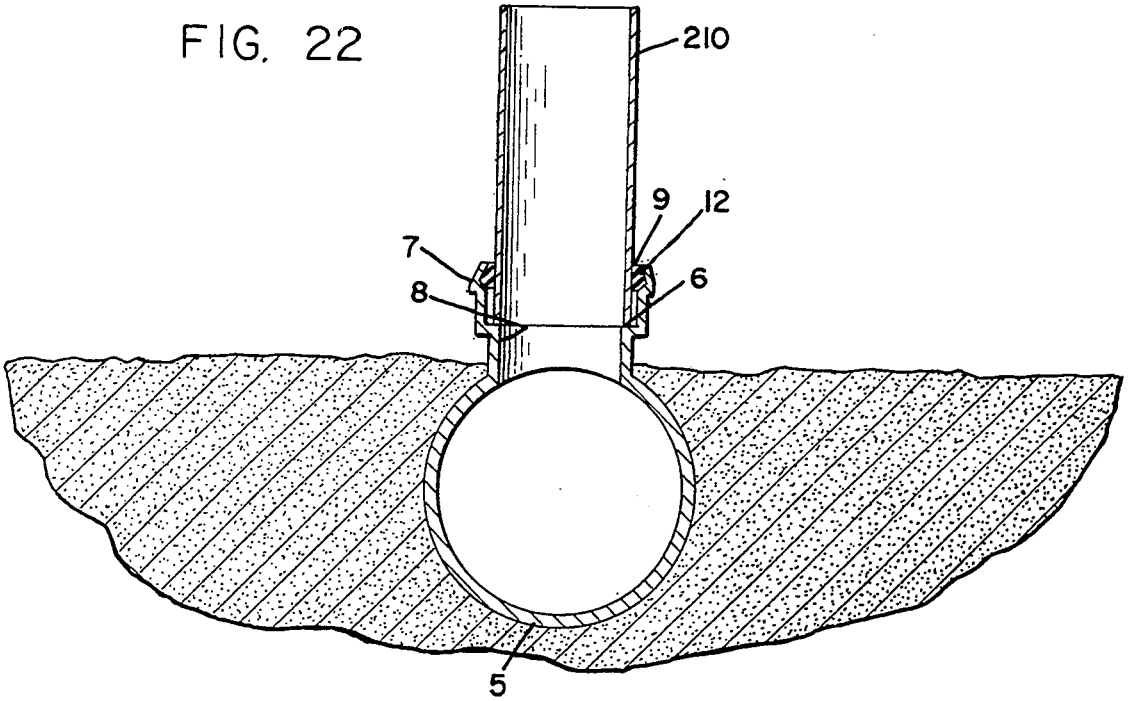
FIGS. 22-25 illustrate the steps in the method of constructing the sewer chimney embodiment which is shown in FIG. 21.
Figure 23:
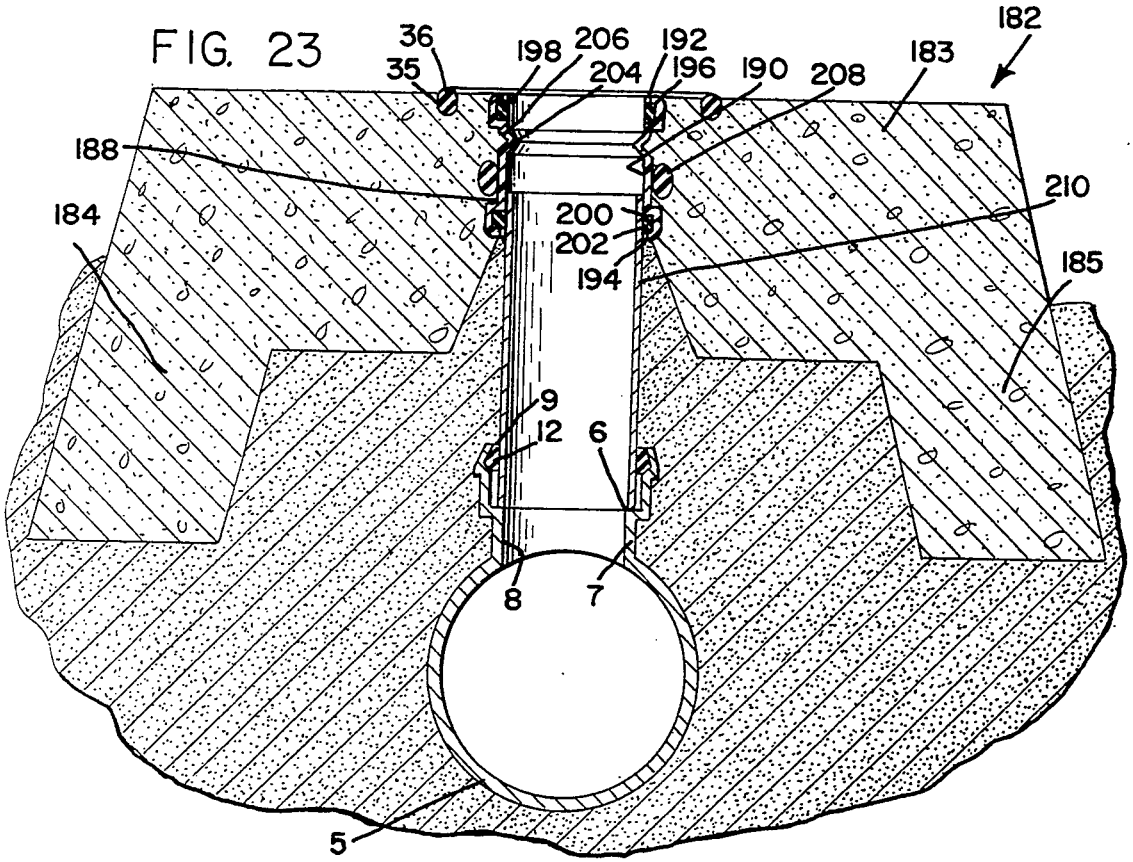
Figure 24:
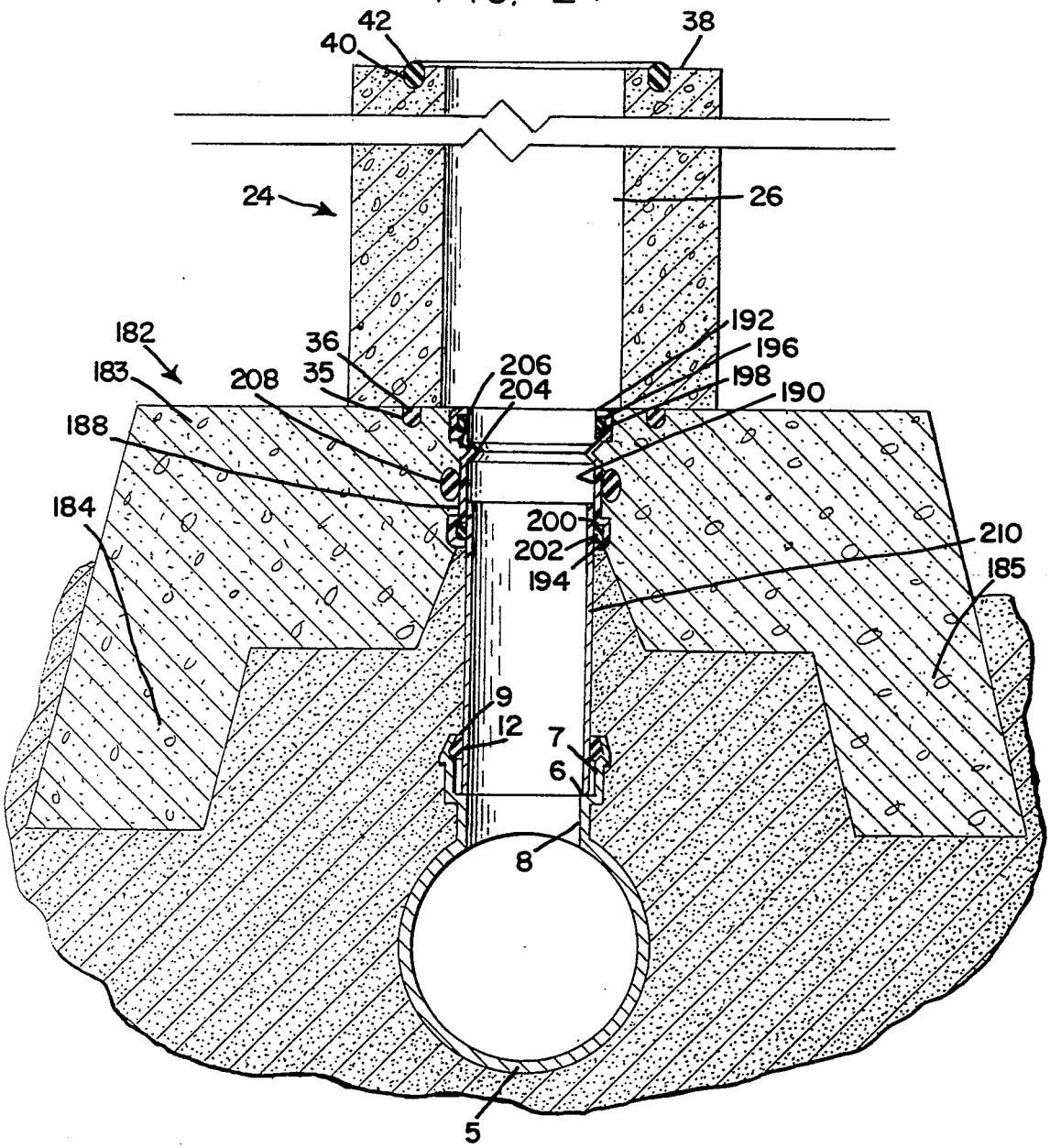
Figure 25:
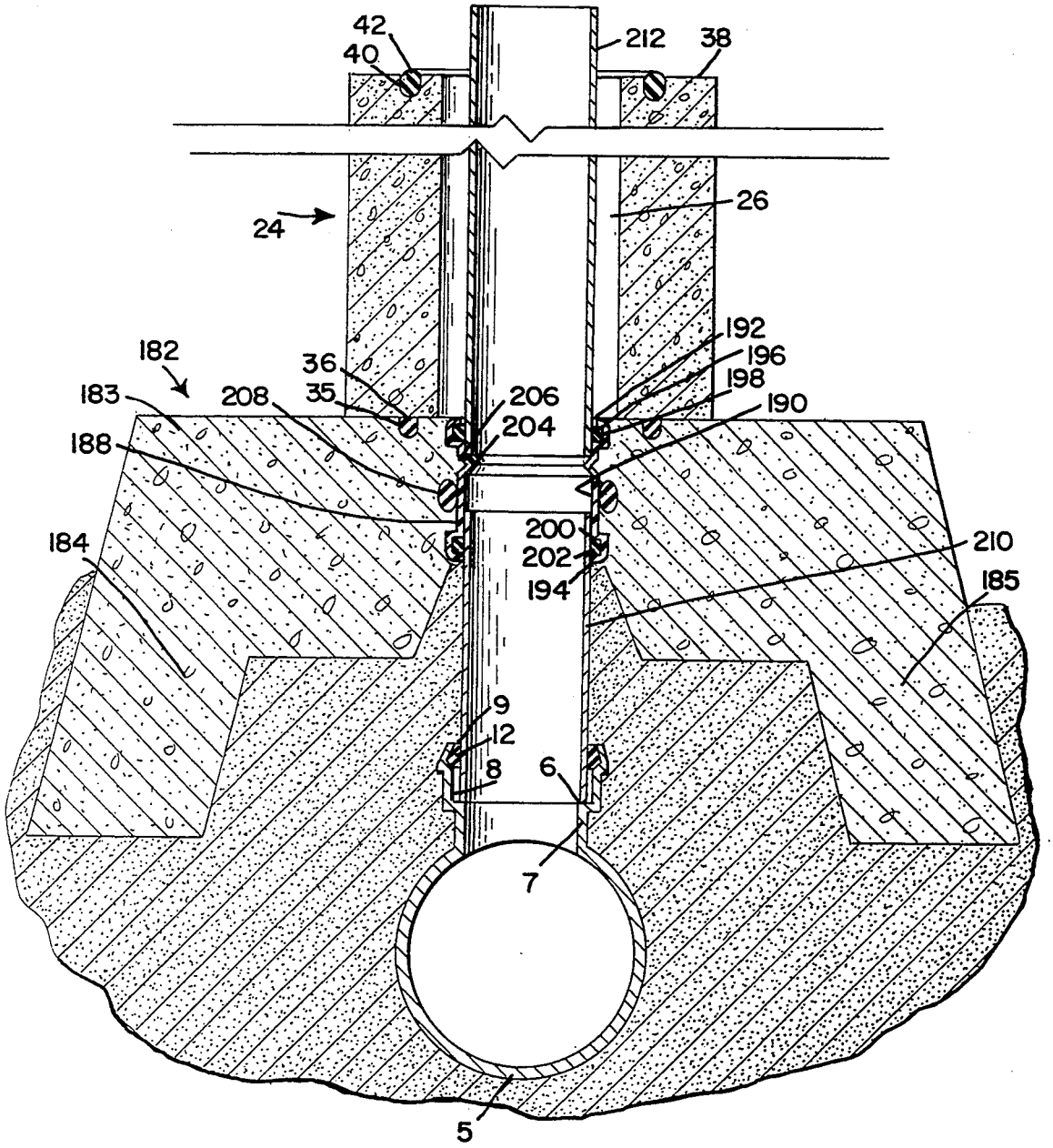
Figure 26:
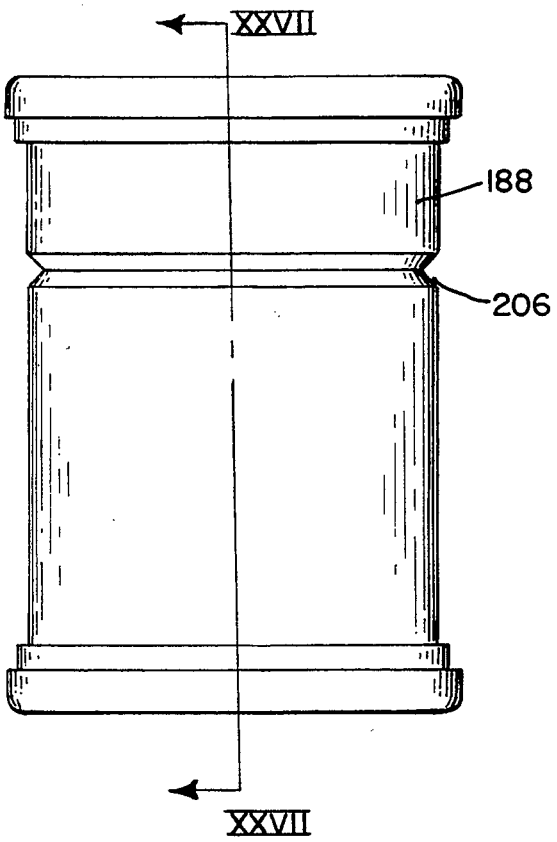
FIG. 26 is an elevational view of a coupling sleeve which forms part of the embodiment of FIG. 21.
Figure 27:
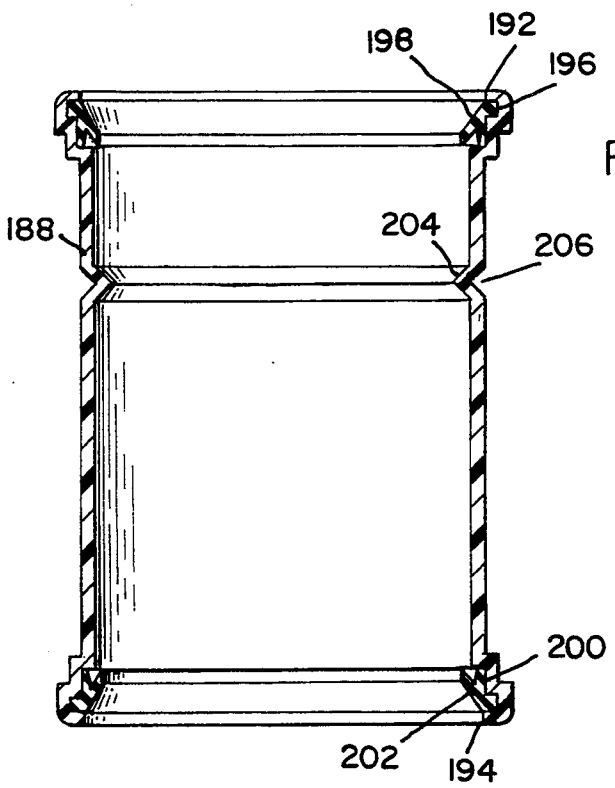
FIG. 27 is a vertical cross-sectional view of the coupling sleeve taken along the line XXVII—XXVII of FIG. 26 and looking in the direction of the arrows.

The steps for constructing the sewer chimney 188 are illustrated in FIGS. 22–25. Construction of the sewer chimney 180 is started by inserting the first pipe 210 into the opening 9 of the fixture 7 so that the bottom of the pipe rests on the annular ridge 6 as shown in FIG. 22. The supporting base 182 is then positioned over the main sewer pipe 5 so that the upper end of the pipe 210 extends through the bottom opening 194 and into the bore 190 to a point which is substantially spaced from the inner ridge 204 as shown in FIG. 23. The gasket 36 is then positioned within the groove 35 and the transitional section 24 is placed on top of the bridge portion 183 as shown in FIG. 24. The second pipe 212 is lowered through the bore 26 of the transitional section 24 and the bottom end of the pipe 212 is inserted into the coupling sleeve 198 through the top opening 192 so that the bottom of the pipe engages the ridge or interior stop 204. The upper end of the second pipe 212 extends above the transition section 24 by a predetermined amount. Depending on the depth of the installation, several transition sections may be used as well as several pipes 212 which are coupled together. If two or more pipes are used, the lower pipe is provided with a coupling enlargement such as the bell 162 of the pipe 160 which is used for the embodiment shown in FIG. 16. If the top of the uppermost pipe 2 12 extends too far above the transition section 24, the excess amount is cut off. In most cases, the pipe 2 12 is positioned in the upper end of the coupling sleeve 188 prior to the application of the transition section or sections 24. Regardless of which is positioned first, when the transition section 24 and the pipe 2 12 are properly positioned as shown in FIG. 25, the gasket 42 is placed within the groove 40 and the cap block 28 is positioned on top of the transition section 24. This completes the construction of the sewer chimney 180 for receiving the branch sewer pipe 3 as shown in FIG. 21. Although the space beneath the bridge 183 can be filled with sand at any time after the insertion of the pipe 210, it is preferred that this function be carried out after the construction of the sewer chimney has been completed. The distance between the top of the first pipe 210 and the inner stop 204 is sufficient to allow for subsequent settling of the chimney structure after the excavation has been backfilled with acceptable backfill material. As the result of settling, the concrete components of the sewer chimney and the pipe 212 will move downwardly relative to the pipe 210.

The bridge portion 15 has a top surface 34 which has a circular groove 35 which contains an "O" ring 36. The transitional section 24 has a top surface 38 which has a circular groove 40 which contains an "O" ring 42. The "O" rings 36 and 42 extend above.

Clearly, minor changes may be made in the form and construction of this invention and in the embodiments of the process without departing from the material spirit of either. Therefore, it is not desired to confine the invention to the exact forms shown herein and described, but it is desired to include all subject matter that properly comes within the scope claimed.

The invention having been thus described, what is claimed as new and desired to secure by Letters Patent is:

What is claimed is:

1. A sewer chimney for connecting a surface branch sewer pipe to a deeply buried main sewer pipe having a fixture with an upwardly facing opening, said sewer chimney comprising:

(a) a base which has first and second leg portions which are positioned on opposite sides of the main sewer line and a bridge portion which extends from said first leg portion to said second leg portion and passes over the main sewer line, said bridge portion having a first vertical bore which is vertically aligned with said upwardly facing opening, (b) a transitional section which rests on and is secured to said bridge portion, said transitional section having a second vertical bore which is vertically aligned with said first vertical bore, (c) a cap block which rests on and is secured to the transitional section, said cap block having a third vertical bore which is vertically aligned with said first and second vertical bores, said cap block having a horizontal bore which intersects said third vertical bore, said horizontal bore having an outer opening which is adapted to receive a branch sewer pipe, (d) a first vertical elongated pipe system which extends from said upwardly facing opening, through said first vertical bore and into said second vertical bore, said first elongated pipe having a top opening and an interior stop which is spaced from said top opening, (e) a second vertical pipe system which extends from said interior stop through the top opening of said first elongated pipe and into said third vertical bore, (f) a first seal between said transitional section and said bridge portion, (g) a second seal between said transitional section and said cap block, (h) a third seal between said pipe and said bridge portion, (i) a fourth seal between said pipe and said cap block, (j) a fifth seal between said pipe and the fixture of said main sewer pipe and, (k) a sixth seal between said first elongated pipe system and said second elongated pipe system.

2. A sewer chimney as recited in claim 1 wherein said first vertical pipe system consists of a first vertical pipe and wherein said second vertical pipe system consists of a second vertical pipe, said first and second vertical pipes having substantially the same interior and exterior diameters, the upper end of said first vertical pipe having an enlarged section which has an internal diameter which is greater than the external diameter of said second vertical pipe so that the bottom end of said second pipe is freely insertable into the upper end of said first pipe.

3. A sewer chimney as recited in claim 2, wherein said interior stop is formed at the lower end of the enlarged section of said first pipe.

4. A sewer chimney as recited in claim 2 wherein said enlarged section has an annular horizontal bulge which forms an annular interior groove, and wherein said sixth seal is an annular gasket which is located within said groove.

5. A sewer chimney as recited in claim 2, wherein each of said third and fifth seals is an annular gasket which extends around and engages the outer surface of said first elongated pipe system and each of said fourth and sixth seals is an annular gasket which extends around and engages the outer surface of said second elongated pipe system.

6. A sewer chimney for connecting a surface branch sewer pipe to a deeply buried main sewer pipe having a fixture with an upwardly facing opening, said sewer chimney comprising:

(a) a base which has first and second leg portions which are positioned on opposite sides of the main sewer line and a bridge portion which extends from said first leg portion to said second leg portion and passes over the main sewer line, said bridge portion having a first vertical bore which is vertically aligned with said upwardly facing opening, said first vertical bore having a top opening and a bottom opening, (b) an interior stop within said first vertical bore said first vertical bore having a top opening and a bottom opening, (c) a transitional section which rests on and is secured to said bridge portion, said transitional section having a second vertical bore which is vertically aligned with said first vertical bore, (d) a cap block which rests on and is secured to the transitional section, said cap a block having a third vertical bore which is vertically aligned with said first and second vertical bores, said cap block having a horizontal bore which intersects said third vertical bore, said horizontal bore having an outer opening which is adapted to receive a branch sewer pipe.

(e) a first vertical pipe which extends from said upwardly facing opening through the bottom opening of said first vertical bore and into said first vertical bore to a joint which is below and spaced from said interior stop, (f) a second vertical pipe which extends upwardly from said interior stop through the top opening of said first vertical bore, said second vertical pipe extending upwardly through said second bore and into said third vertical bore, (g) a first seal between said second vertical pipe and said cap block, (h) a second seal within said first vertical bore between said base and said first vertical pipe.

(i) a third seal within said first vertical bore between said base and said second vertical pipe, and (j) a fourth seal between said first vertical pipe and the fixture of said main sewer pipe.

7. A sewer chimney as recited in claim 6, further comprising:

(a) a fifth seal between said transitional section and said bridge portion, and (b) a sixth seal between said transitional section and said cap block.

8. A sewer chimney as recited in claim 6, wherein each of said seals is an annular gasket.

9. A sewer chimney as recited in claim 6 wherein a vertical sleeve is located within said bridge portion, said sleeve having an inner annular surface which defines said first vertical bore, said inner annular surface having an annular ridge which constitutes said interior stop.

10. A sewer chimney as recited in claim 9, further comprising a seventh seal between said sleeve and said bridge portion.

11. A sewer chimney as recited in claim 9, wherein said base is formed of concrete and said sleeve is formed of a thermoplastic material.

12. A sewer chimney for connecting a surface branch sewer pipe to a deeply buried main sewer pipe having a fixture with an upwardly facing opening, said sewer chimney comprising:

(a) a base which has first and second leg portions which are positioned on opposite sides of the main sewer line and a bridge portion which extends from said first leg portion to said second leg portion and which passes over the main sewer line, said bridge portion having a first vertical bore which is vertically aligned with said upwardly facing opening, said first vertical bore having a top opening and a bottom opening, (b) an interior stop within said first vertical bore, (c) a transitional section which rests on and is secured to said bridge portion, said transitional section having a second vertical bore which is vertically aligned with said first vertical bore, (d) a cap block which rests on and is secured to the transitional section, said cap block having a third vertical bore which is vertically aligned with said first and second vertical bores, said cap block having a horizontal bore which intersects said third vertical bore, said horizontal bore having an outer opening which is adapted to receive a branch sewer pipe, (e) a first vertical pipe system which extends from said upwardly facing opening through the bottom opening of said first vertical bore and into said first vertical bore to a point which is below and spaced from said interior stop, (f) a second vertical pipe system which extends upwardly from said interior stop through the top opening of said first vertical bore, said second vertical pipe system extending upwardly through said second bore and into said third vertical bore, (g) a first seal between said transitional section and said bridge portion, (h) a second seal between said transitional section and said cap block, (i) a third seal between said second vertical pipe system and said cap block, (j) a fourth seal within said first vertical bore between said base and said first vertical pipe system, (k) a fifth seal within said first vertical bore between said base and said second vertical pipe system, and (l) a sixth seal between said first vertical pipe system and the fixture of said main sewer pipe.

13. A sewer chimney for connecting a surface branch sewer pipe to a deeply buried main sewer pipe having a fixture with an upwardly facing opening, said sewer chimney comprising:

(a) a base which has first and second leg portions which are positioned on opposite sides of the main sewer line and a bridge portion which extends from said first leg portion to said second leg portion and passes over the main sewer line, (b) a coupling within said bridge portion, said coupling having a first vertical bore which is vertically aligned with said upwardly facing opening, said bore having a top opening, a bottom opening and an internal stop, (c) a transitional section which rests on and is secured to the bridge, said transitional section having a second vertical bore which is vertically aligned with said first vertical bore, (d) a cap block which rests on and is secured to the transitional section, said cap block having a third vertical bore which is vertically aligned with said first and second vertical bores, said cap block having a horizontal bore which intersects said third vertical bore, said horizontal bore having an outer opening which is adapted to receive a branch sewer pipe, (e) a first vertical pipe which extends upwardly from the fixture of said main sewer pipe and into said first vertical bore to a point which is below and spaced from said internal stop portion, (f) a second vertical pipe which extends upwardly from said internal stop through the top opening of said first vertical bore, through the second vertical bore in said transitional section and into the third vertical bore of said cap block, (g ) a first seal between said second vertical pipe and said cap block, (h) a second seal between said coupling and said second vertical pipe, (i) a third seal between said coupling and said first vertical pipe, and (j) a fourth seal between said first vertical pipe and the fixture of said main sewer pipe.

14. A sewer chimney as recited in claim 13, further comprising:

(a) a fifth seal between said transitional section and said bridge portion, and (b ) a sixth seal between said transitional section and said cap block.

15. A sewer chimney as recited in claim 13, wherein each of said seals is an annular gasket.

16. A sewer chimney as recited in claim 13, wherein said coupling has an inner annular surface which defines said first vertical bore, said inner annular surface having an annular ridge which constitutes said interior stop.

17. A sewer chimney as recited in claim 13, further comprising a seventh seal between said coupling and said bridge portion.

18. A sewer chimney as recited in claim 13, wherein said base is formed of concrete and said coupling is formed of a thermoplastic material.

19. A sewer chimney as recited in claim 18, wherein said coupling is a sleeve which has a cylindrical wall between said second and third seals, said cylindrical wall having an inwardly directed jut which forms an inner annular ridge that functions as said internal stop and an outer annular groove which functions to physically lock said sleeve within said base.

* * * * *